US007635323B2

(12) United States Patent
Halbridge

(10) Patent No.: US 7,635,323 B2
(45) Date of Patent: Dec. 22, 2009

(54) EXERCISE APPARATUS

(76) Inventor: Adam Halbridge, 3344 Russell St., San Diego, CA (US) 92106

( * ) Notice: Subject to any disclaimer, the term of this patent is extended or adjusted under 35 U.S.C. 154(b) by 0 days.

(21) Appl. No.: 12/168,919

(22) Filed: Jul. 8, 2008

(65) Prior Publication Data

US 2009/0017999 A1 Jan. 15, 2009

Related U.S. Application Data

(63) Continuation-in-part of application No. 11/458,549, filed on Jul. 19, 2006, now abandoned.

(51) Int. Cl.
*A63B 21/04* (2006.01)
*A63B 21/02* (2006.01)

(52) U.S. Cl. ..... 482/130; 482/121

(58) Field of Classification Search ..... 482/121, 482/126, 129–130, 904
See application file for complete search history.

(56) References Cited

U.S. PATENT DOCUMENTS 1,585,748 A * 5/1926 Wendelken ..... 482/143
4,913,419 A * 4/1990 McAuliffe ..... 482/87
5,123,866 A * 6/1992 Endo et al. ..... 439/752
6,099,445 A * 8/2000 Rovinsky et al. ..... 482/121
7,137,935 B2 * 11/2006 Clarke et al. ..... 482/123
7,361,127 B2 * 4/2008 Tremayne ..... 482/130
2007/0093366 A1 * 4/2007 Zuckerman ..... 482/121

* cited by examiner

*Primary Examiner*—Fenn C Mathew
(74) *Attorney, Agent, or Firm*—Roger A. Jackson

(57) ABSTRACT

An exercise apparatus for use with a chair, the chair having a base, a pedestal, and a seat, the exercise apparatus includes a support assembly adapted to removably attach to the pedestal, an elongate resilient member having a proximal end portion and a distal end portion with the proximal end portion being adjacent to the support assembly. Further, on the distal end portion is an attachment element, wherein the attachment element is adapted to removably engage to a portion of human anatomy for the purpose of exercise by extending of the elongate resilient member by moving the attachment element away from the support assembly causing a resistive force at the attachment element. Wherein, operationally the elongate resilient member has substantially free omni-directional movement by not contacting the seat when being used for exercise.

4 Claims, 35 Drawing Sheets

EXERCISE APPARATUS

RELATE APPLICATIONS

This patent application is a continuation in part application of application Ser. No. 11/458,549 filed on Jul. 19, 2006 by Adam Halbridge, now abandoned.

TECHNICAL FIELD

The present invention generally relates to an apparatus for accomplishing exercise in a non traditional exercise or working out environment, wherein an individual does not have ready access to a gym, health club, spa, or other type of facility for exercise or working out. More particularly, the present invention is an exercise apparatus that is adapted to be adjacent to a readily available piece of furniture that an individual uses in an office or work environment to facilitate exercise in a convenient time and place, thus allowing the individual to enjoy the health benefits of exercise when circumstances don't readily allow for the time and expense of using a traditional exercise facility, such as a gym, health club, spa, and the like.

BACKGROUND OF INVENTION

The health benefits of exercise are well known and applicable to all ages of individuals, including cardiovascular improvement, muscle strengthening, stretching, increased blood circulation, better coordination, sharper motor abilities, flexible joint mobility, bone health, general overall wellness, and the like. One problem as an individual typically moves from being a child to being an adult, their physical activity levels decline just when maintaining good health is at its most important as an individual ages, typically their exercise levels decline that can work against maintaining good health, thus just when an individual should be exercising and being active, their exercise and activity levels tend to decrease. Children are normally active in going places (i.e. walking or riding a bike), playing active games in their spare time, such as football, soccer, baseball, tag, hide and seek, and the like, plus being in school children are also active in physical education classes and after school hours sports leagues. Thus as children we are normally plenty active and in the best of health due to our young age. However, as we become adults, societal norms tend to drive us into a much more sedentary lifestyle, for instance by having a car, we tend to walk very little, nor ride a bicycle much, and as an office worker we tend to sit at a desk for long periods of time, sit in meetings, sit on airplanes, and then go out for high fat and calorie content meals at high end restaurants, thus as a result most adults tend to gain weight by consuming more calories coupled with a lower activity lifestyle, just when our bodies should be in better shape to compensate for aging we typically get in worse shape.

Although the benefits of exercise especially for adults are acknowledged by most everyone for weight control, maintaining agility, preventing diabetes, preventing joint stain from excessive body weight, preventing higher various internal organ workloads (especially the heart) from excessive body weight, and so on, few adults are active enough to maintain even a recommended weight, typically being only about one-fourth of the adult population is not overweight. So the question to ask is, why don't the majority of adults exercise especially if the health benefits are widely known? One probable answer is that available time and convenience are a problem for engaging in an exercise program, as most adults have a full time job, a family, and other interests that all together consume most of an adults time. Thus, a potentially helpful solution is to minimize the time and convenience obstacles to allow for an exercise program to be possible for a working adult.

This issue is well-recognized to the prior art wherein there are a number of portable exercise machines available that vary considerably in complexity and what they use to exercise with, such as a chair, or a desk, or the like, or the portable exercise machine can be a standalone type item. One prior example is in United States patent application publication number US2005/0239616 A1 to Tuller et al., that discloses an abdominal exercise machine that includes a semi rigid center member having an upper member adapted to be grasped by the hands of the user and a lower member adapted to contact the user's lap, wherein the semi rigid member center member is placed adjacent to the chest of the user, with the user grasping the upper member with their hands and placing the lower member against their lap and performing abdominal type "crunch" exercises by leaning forward and flexing the semi rigid member. Thus, Tuller et al., is a small and portable device, however, being limited to strictly abdominal type exercises. Another example in the prior art of exercise machines using flexible members is given in U.S. Pat. No. 4,725,057 to Shifferaw which is a continuation U.S. Pat. No. 4,620,704 also to Shifferaw of which both patents disclose a portable universal exercise machine that includes a plurality of resilient flexible rods wherein each rod has one end that is fixed in a base portion of the exercise machine with each rod being positioned in a cantilever fashion having a free end that has a removable cable type member attached to it, wherein the cable type member is routed through a series of pulleys having on its other end a bar or a handgrip for the user to grasp. Thus, in Shifferaw when the user effectuates a movement upon the handgrip or with the bar the cable type member is moved through the pulleys and eventually creates a unidirectional force on the free end of the cantilevered resilient flexible rod which resists movement thereby creating resistance for the exercise movement. The advantage of Shifferaw is that a plurality of flexible members can be utilized to create varying levels of exercise movement resistance and also with the advantage of a more lightweight and compact exercise machine due to the relatively small size and lightweight of the flexible rod members as compared to conventional weight machines that would utilize steel weight plates there are quite heavy and bulky.

A further example in the prior art of exercise machines using flexible members is given in U.S. Pat. No. 5,453,064 to Williams, Jr. that discloses an exercise glove that incorporates flexible resistance strips parallel to the lengthwise finger portions of the glove, thus allowing the user to flex their hand while wearing the glove with the purpose to strengthen their hands due to the increased resistance of flexing the glove from the flexible resistance strips. Again, in Williams, Jr., Shifferaw, and Tuller et al., the current technology dictates that a portable exercise machine can beneficially take advantage of some sort of flexible composite elements to generate exercise movement resistance for the exercise desired and as previously stated these flexible composite elements are typically small and lightweight which is a necessary advantage of the portable exercise machine. However, there are other methods of creating exercise movement resistance besides use of a conventional weight mass, such as springs as disclosed in U.S. Pat. No. 5,816,983 to Dawes et al., or the form of a mechanical resistance clutch utilizing a cable attached to a handgrip, wherein pulling on the handgrip that is on the cable activates the resistance clutch that provides resistance to the cable movement for exercise with an example being in U.S. Pat. No. 5,813,953 to Whipple.

Moving to the prior art that discloses portable exercise machines that are adapted to attached to be piece of office furniture, for instance in United States patent application publication number US2004/0053756 A1 to Tremayne that discloses an exercise device utilizing handles having movement resistance connected to a chair, wherein the device is separable from the chair being adapted to attach to a standard chair. The exercise device in Tremayne has foldable handle supports and a leg exercise option with the resistance being in a combination of a resilient element and pulleys housed in a series of telescopic segments that extend when the handle is pulled to protect the user from exposure to the resilient element and to change pulley spacing to vary resistance. Similarly, in U.S. Pat. No. 6,099,445 to Rovinsky et al., also disclosed is an exercise device that attaches to a chair by having its own separate frame for the exercise device that further includes several exercise attachments working in conjunction with resilient elements with handles and the like for exercise movement resistance. Continuing, in a similar manner in United States patent application publication number US2002/0142898 A1 is et al., disclosed is a pair of exercise handles that can each attach to an office chair or a desk, with variable resistance being effectuated by frictional members at joints or couples in the exercise handles, also to the same inventor Willis et al., in United States patent application publication number US2002/0137606 A1 as a complement to the previously described Willis et al., exercise handles, which disclosed is a portable leg or arm powered exercise device that rests on the ground wherein the resilient resistance elements are attached between the device and the chair seat enabling the user to exercise either their legs or arms.

An additional patent for an exercise apparatus adaptable to an office chair includes U.S. Pat. No. 7,137,935 B2 to Clarke et al., disclosed a T-shaped strap used to wrap around a chair post and under the chair base, secured by laces, and utilizes elastic bands for exercise resistance. The user in Clarke et al. can attach the elastic bands to the T-shaped strap and exercise the limb that extends the elastic bands away from the T-shaped strap. The novel element in the exercise device disclosed in Clarke et al. is the support in the form of a T-shaped strap that is portable and can be attached to a large variety of office chairs. However, there are a few disadvantages to this design described by Clarke et al. Wherein Clarke et al. describes wrapping the strap around the post and chair base in a manner that does not allow the user to adjust the seat height in a position that would require the chair post to extend below the base, as is common in a vertically adjustable office chair with a long threaded rod protruding from the bottom of the typically five (star shaped) extension base, with a castor wheel at the end of each extension. The means of securing by lacing the T-shaped strap to the chair, as described by Clarke et al., can be cumbersome and time consuming, making the engaging/removal process of the T-shaped strap to the chair pedestal burdensome. In addition, the elastic bands in Clarke et al. cannot move freely without contacting the chair seat outer periphery edge, see FIGS. 1A and 3. This results in Clarke et al., having exercise movement when manually extending the elastic bands that is not free from obstruction, i.e. the seat outer periphery leading to inconsistent resistive forces from the elastic band contacting the seat outer periphery, making the spring "K" factor of the elastic band undesirably randomly variable, this also subjects the elastic band to additional deterioration from friction with the seat outer periphery, possibly leading to rips, tears, and fracturing of the elastic band that could be an unexpected safety hazard to the user.

Further, on exercise machines that are adapted to be attached to a conventional chair in U.S. Pat. No. 6,159,133 to Shugg disclosed is a seat mounted workout station that utilizes springs, cables, and pulleys for exercise movement resistance as opposed to resilient elements, thus a drawback to Shugg would be in the mechanical complexity and additional weight and bulk that would accompany the use of springs, cables, and pulleys as opposed to resilient elements. Another prior example is in an exercise device that is adapted to attach to a chair using resilient elements being in U.S. Pat. No. 6,117,056 to Cataldi, Jr. et al. that discloses an isotonic exercise device that attaches to the chair utilizing elastic or resilient bands that have removably engagable hand or ankle grips. Also, in this same area in U.S. Pat. No. 5,921,900 to Mankovitz disclosed is an exercise apparatus for use with a chair having resilient elements that are attached to the chair frame and that are also affixed to the roller elements that are in contact with the floor surface, in using the exercise apparatus, the user's feet rest against the roller elements and exert force against the resilient elements for a leg exercise as the roller elements move along the floor surface. Other prior art examples for chair related exercise machines are in U.S. Pat. No. 5,362,296 to Wang et al., that discloses a chair mounted exercise unit that utilizes elastic pull ropes and pulleys that attach to the seat back, wherein the ropes terminate in adjustable hand grips. Another prior example would be in U.S. Pat. No. 5,324,243 to Wilkinson that discloses a seat back unit similar to Wang et al., utilizing either resilient elements or springs for resistance to the exercise movement having the addition of a rotatable hub, wherein the rotatable hub provides additional exercise options for the user's arms and legs. In a somewhat similar vein, in U.S. Pat. No. 5,090,694 to Pauls et al., disclosed is a chair exercise unit having hand grips on cord elements, wherein these cord elements are attached to a load resistance means in the form of a centrifugal friction system mounted underneath the seat back, as opposed to the more conventional resilient elements or spring type designs.

Another offshoot in the chair exercise machine prior art is in U.S. Pat. No. 4,921,247 to Sterling that discloses an exercise chair, wherein exercise machine is not adapted to be attached as an add-on to the chair but the chair itself is an integral exercise machine having built in hand grips with spring resistance elements and a bicycle type pedal arrangement that extends from the chair front. Also in the integral exercise chair machine area, an example is given in U.S. Pat. No. 217,918 to White that discloses an exercise chair having integral springs, pulleys, and ropes to exercise the arms and the legs.

A number of versions of portable exercise machines have been previously discussed, upon looking at the numerous disclosures in the prior art, a few common attributes of portable exercise machines are noted, being the requirement of small size, lightweight, the ability to stow away easily, and if a chair or desk is utilized in conjunction with the portable exercise machine wherein the portable exercise machine is sized and configured to attach/detach from the chair or desk in an easy and convenient manner. As all exercise machines rely upon a means to create exercise movement resistance, the portable exercise machine has a narrow group of options in this area, wherein conventional weights that are made from either steel or concrete are typically out of the question due to their size and bulk so that other means of exercise movement resistance must be used. These other means of movement resistance would include resilient members similar to large rubber bands, wherein the movement resistance is derived from stretching the rubber band, or a flexible rod wherein the movement resistance comes from the lateral bending of the rod, or springs, which would function similarly to the resilient elements in creating resistance, or some sort of mechanical friction device, such as a clutch that would typically resist lateral movement of a cable that is on a spool. The key in a portable exercise machine that is adaptable to an office chair is that it needs a means for securing it which adds a further complication, such that nuts and bolts, or apertures and laces are required. Thus, this attachment to an office chair could be complicated, time consuming and may require additional tools to assemble, while restricting certain functions of the furniture when attached. What is needed therefore, is a portable exercise machine that is lightweight, fast and easy to attach, without the use of additional tools, and allows for the chair to maintain its adjustability, unlike in the disclosed prior in particular, Clarke et al. This means for attaching the portable exercise machine could be accomplished by the use of a support structure in the shape of a clam shell removably attachable by encasing a chair pedestal and fastened with quick release fasteners along the split line of the clamshell, thus allowing the pedestal to move along its lengthwise axis while user is adjusting the height of the seat without the need for a strap wrapping around and underneath the chair base.

SUMMARY OF INVENTION

Broadly, the present invention of an exercise apparatus is for use with a chair, the chair having a base, a pedestal, and a seat, with the exercise apparatus including a support structure that is adapted to removably attach to the chair pedestal, the support structure is also to be substantially adjustably interposed between the chair base and the chair seat. Also included in the exercise apparatus is an elongate resilient member having a proximal end portion and a distal end portion, the member proximal end portion is adjacent to the support structure. Further included in the exercise apparatus is an attachment element adjacent to the member distal end portion, wherein the attachment element is adapted to removably engage to a portion of human anatomy for the purpose of exercise by extending along the longitudinal axis of the elongate resilient member by moving the attachment element away from the support structure causing a resistive force at the attachment element with the force wholly determined by the spring rate of the member.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
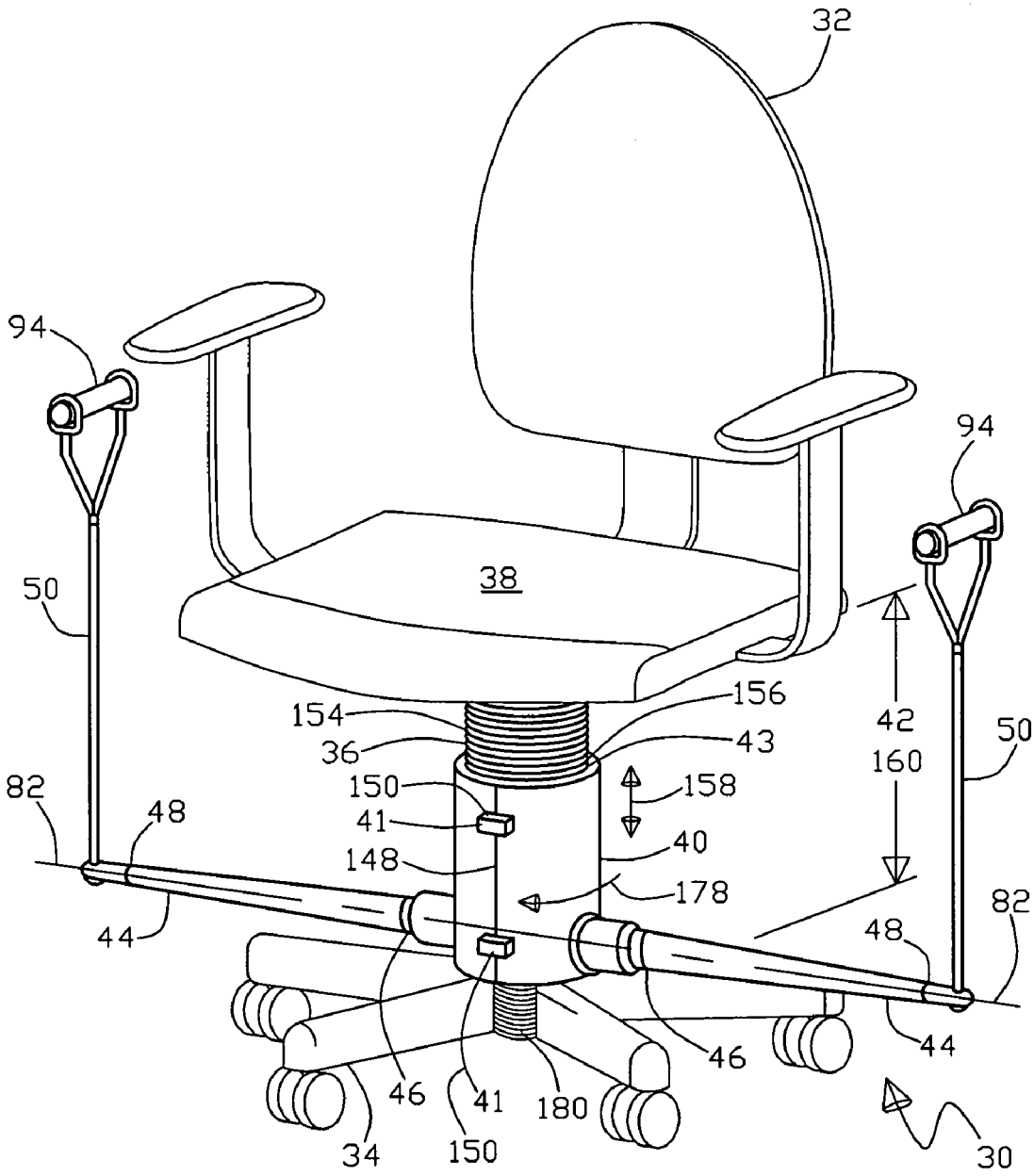
FIG. 1 shows a perspective view of an exercise apparatus.

30 Exercise apparatus
31 Exercise apparatus, alternative embodiment
32 Chair
34 Base of the chair 32
36 Pedestal of the chair 32
37 Lengthwise axis of the chair pedestal 36
38 Seat of the chair 32
39 Outer margin portion of the chair seat 38
40 Support structure
41 Removable attachment of support structure 40
42 Distance between the chair base 34 and the chair seat 38
43 Adjustable interposing of support structure 40 or support assembly 400 between the chair base 34 and the chair seat 38
44 Resilient flexing rod
46 First end proximal portion of the resilient rod 44
48 Second end distal portion of the resilient rod 44
50 Attachment element
51 Removable engagement of attachment element 50
52 Exercising human user
54 Anatomy of the exercising human 52
56 Bicep curl exercise movement
58 Deltoid lateral arm raise exercise movement
64 Triceps arm extension exercise movement
68 Military arm press exercise movement
70 Elongate resilient member
71 Spring rate of the elongate resilient member 70
72 Proximal end portion of the elongate resilient member 70
74 Distal end portion of the elongate resilient member 70
76 Longitudinal axis of the elongate resilient member 70
77 Free state of member 70
78 Free omni-directional movement of the elongate resilient member 70 by not contacting the seat 38 outer margin portion 39
79 Expansion, extension, or movement of the elongate resilient member 70 along the longitudinal axis 76 away from the support assembly 400
80 Omni directional movement of flexing rod 44
81 Non-contacting the seat 38 outer margin 39 by the elongate resilient member 70
82 Axis, lengthwise of rod 44
83 Substantial parallel position of longitudinal axis 76 and the lengthwise axis 37
84 Force, resistive for exercise movement
85 Substantially symmetric cross section of rod 44
86 Selectively rotatably lockable socket
87 Rotational axis of socket 86
88 Non symmetric cross-section of rod 44 substantially in the form of a rectangle
89 Non symmetric cross-section of rod 44 substantially in the form of an ellipse
90 Rotation of rod 44 about rod lengthwise axis 82
91 Thickness of non symmetric cross section of flexible rod 44
93 Radius of non symmetric cross section of flexible rod 44
94 Handgrip of the attachment element 50
95 Foot harness of the attachment element 50
96 Selectively lengthwise adjustable extension of attachment element 50
98 Selectively removable engagement for the handgrip 94 of the selectively lengthwise adjustable extension 96
99 Selectively removable engagement for the foot harness 94 of the selectively lengthwise adjustable extension 96
102 Rod 44 non symmetric cross section substantially in the form of a rectangle
104 Major axis of rod 44 non symmetric cross section
106 Minor axis of rod 44 non symmetric cross section
126 Strap
128 Selectable lengthwise locking element for strap 126
140 Disk for selectively rotatably lockable socket 86
142 Apertures for disk 140
144 Extension for selectively rotatably lockable socket 86
146 Removable engagement for extension 144
145 Socket 86 at a particular rotational position
148 Internally engaging split clamshell for support structure 40 removable attachment 41
149 Split line of clamshell 148
150 Quick release fasteners that are adjacent to the split of the clamshell 148
151 Inner engaging surface of split clamshell 148
152 Split resilient liner of split clamshell 148
154 Externally engaging substantially hollow lengthwise split shaped cylinder
156 Engagement of substantially hollow lengthwise split shaped cylinder 154 and split clamshell 148
158 Lengthwise telescopic movement of the support structure 40
160 Variable distance between the chair base 34 and the chair seat 38
162 Structure to rotatably and pivotally engage the rod second end 48 to the attachment element 50
164 Rotational movement of the attachment element 50 to the rod second end 48
165 Pivotal movement of the attachment element 50 to the rod second end 48
166 Flexible sleeve
168 Distal end fitting
170 Proximal end fitting
172 Outer surface of the flexible rod 44 having a cross section substantially in the form of a rectangle 88
174 Outer surface of the flexible rod 44 having a cross section that is substantially symmetric 85
175 Outer surface of the second end distal portion 48 of the flexible rod 44
400 Support assembly
410 Removable attachment of the support assembly 400
1480 Internally engaging split clamshell for support assembly 400 removable attachment 410
1490 Split line of the clamshell 1480 and clamshell halves 1905
1500 Means for removably engaging the split clamshell 1480 and clamshell halves 1905
1510 Inner engaging surface of the split clamshell 1480
1520 Split resilient liner of the split clamshell 1480
1530 Quick release fasteners that are adjacent to the split line 1490 of the clamshell 1480
1540 Externally engaging substantially hollow lengthwise split shaped cylinder of clamshell 1480
1550 A cylindrical axis positioned substantially radial to the lengthwise axis 37
1560 Removable engagement of the substantially hollow lengthwise split shaped cylinder 1540 and split clamshell 1480
1570 Inner surface of the clamshell 1480

1800 Extension of the support structure 400
1810 Extension axis of extension 1800
1820 First end portion of the extension 1810
1830 Substantially perpendicular relationship of extension axis 1810 and lengthwise axis 37
1840 Second end portion of the extension 1810
1860 Outer periphery portion of the support assembly 400
1880 Aperture disposed within the outer periphery 1860
1900 Latching hook to attach elongate resilient member 70 to the support assembly 400 extension 1800
1905 Outer removably attachable semi circular lengthwise split clam shell halves
1910 Force radially clamping as against chair 32 pedestal 36

DETAILED DESCRIPTION

Figure 2:
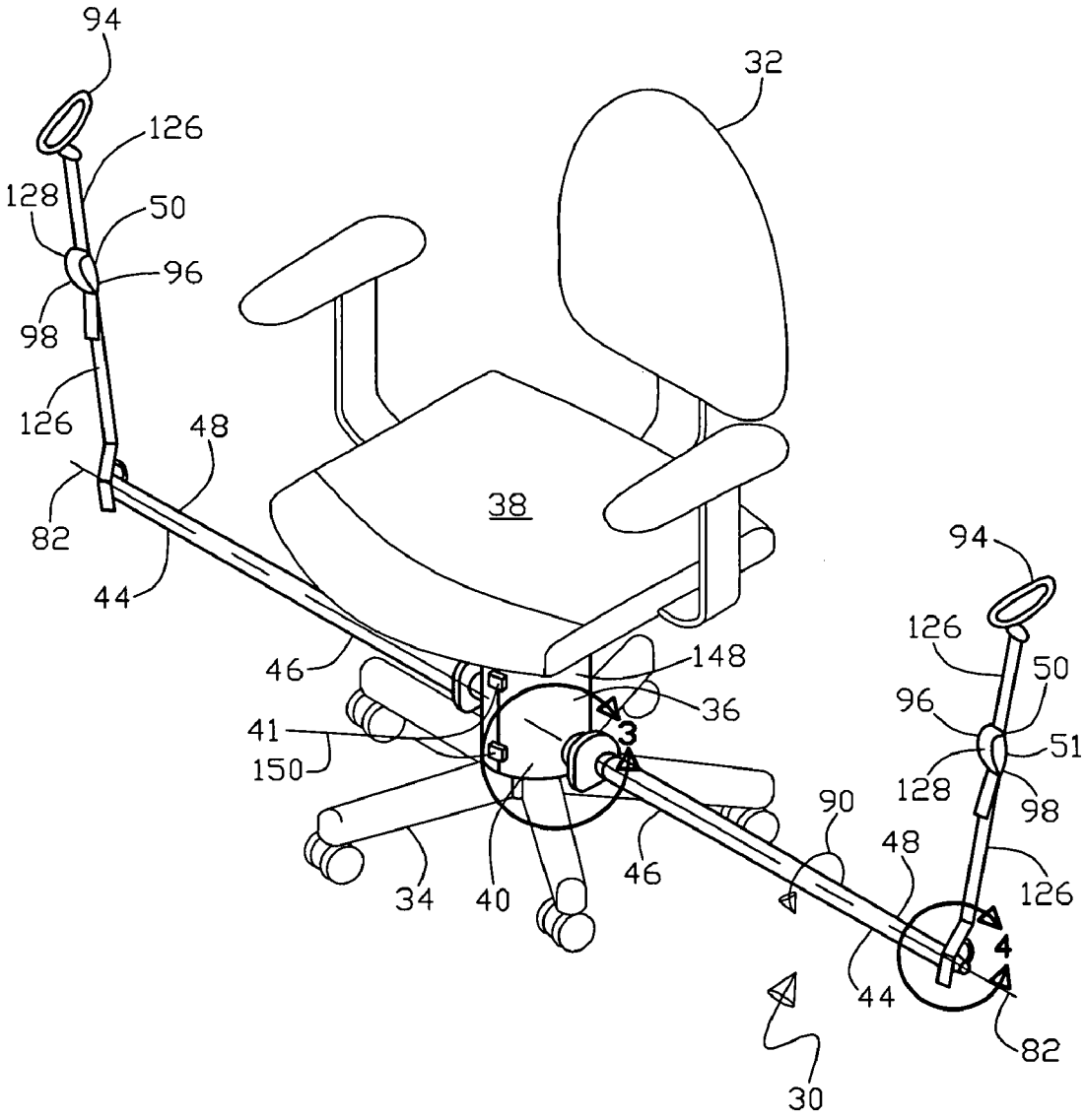
FIG. 2 shows a perspective view of the exercise apparatus denoting the expanded views as shown in FIG. 3 and FIG. 4.
Figure 3:
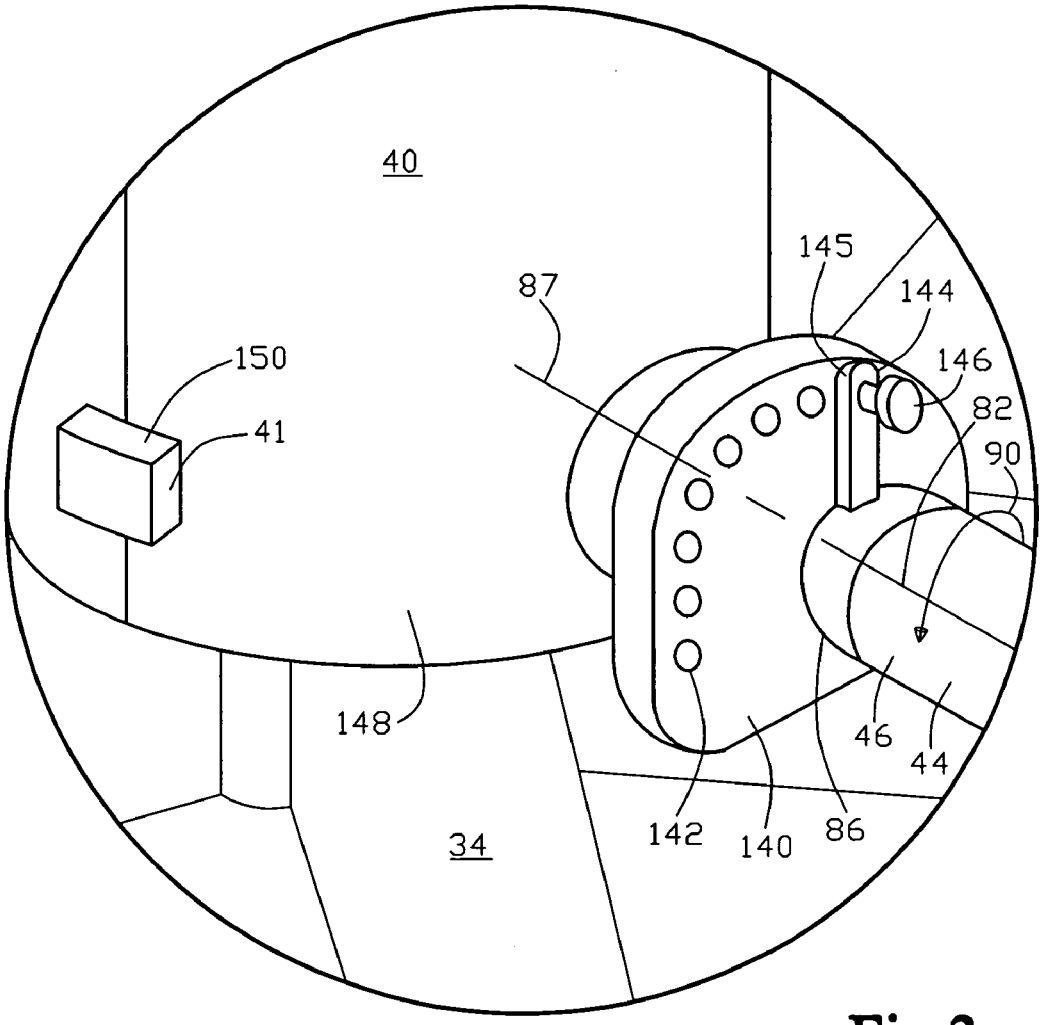
FIG. 3 shows an expanded perspective view of a selectably rotatable lockable socket.
Figure 4:
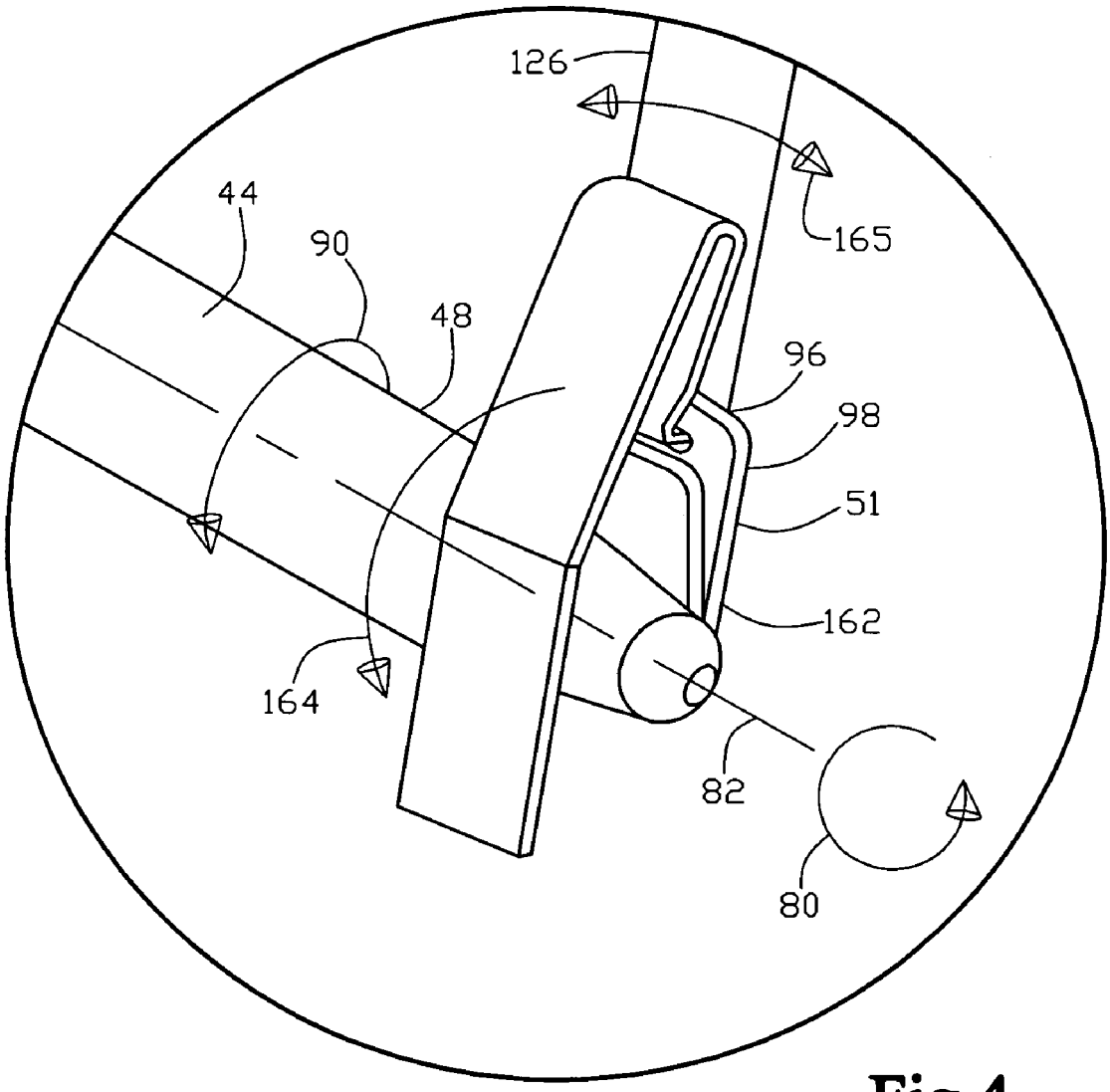
FIG. 4 shows an expanded perspective view of an attachment element, specifically a removable engagement with rotational and pivotal movement.
Figure 5:
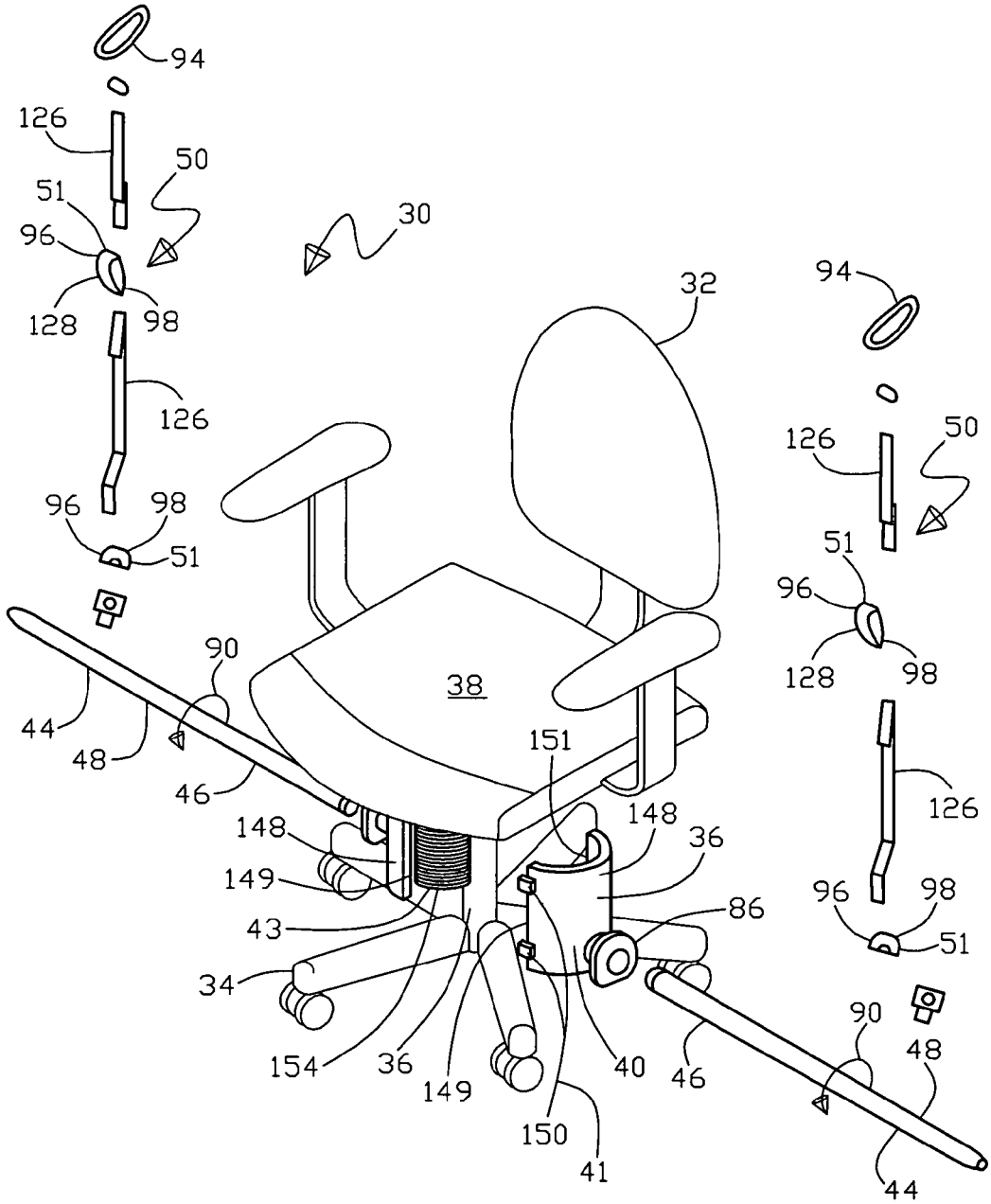
FIG. 5 shows an exploded perspective view of the exercise apparatus.
Figure 6:
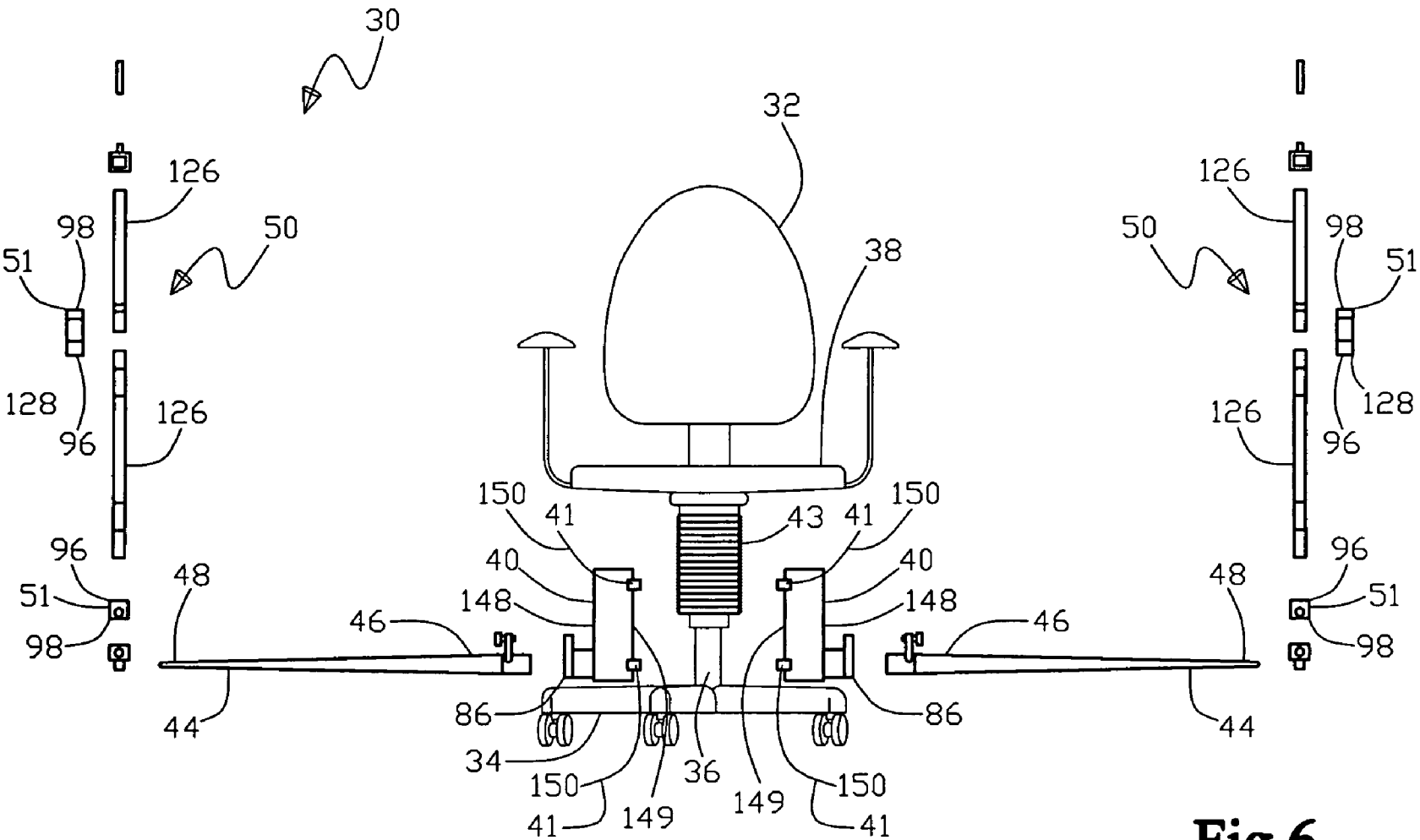
FIG. 6 shows an exploded front view of the exercise apparatus.
Figure 7:
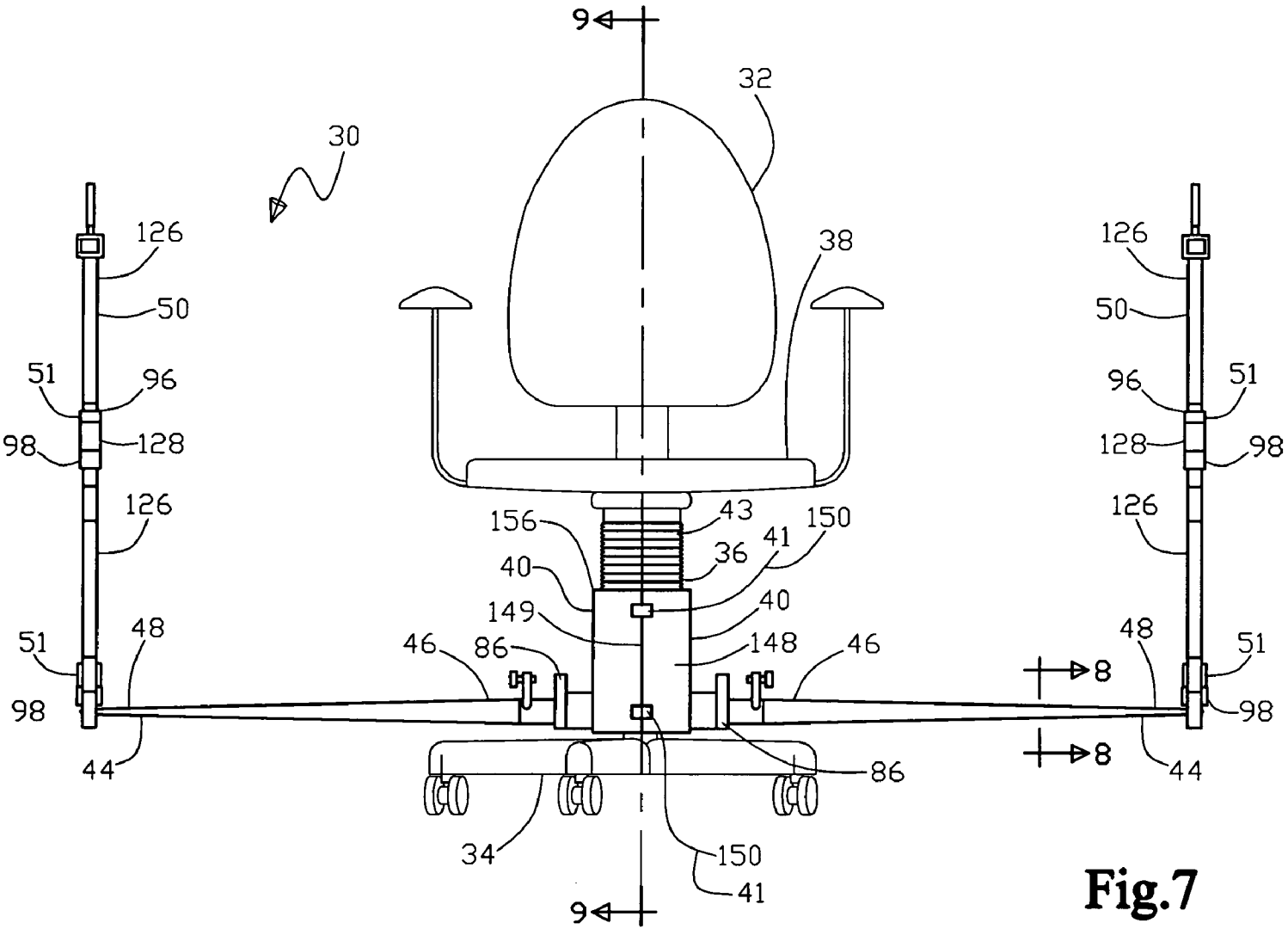
FIG. 7 shows an assembled front view of the exercise apparatus.
Figure 8:
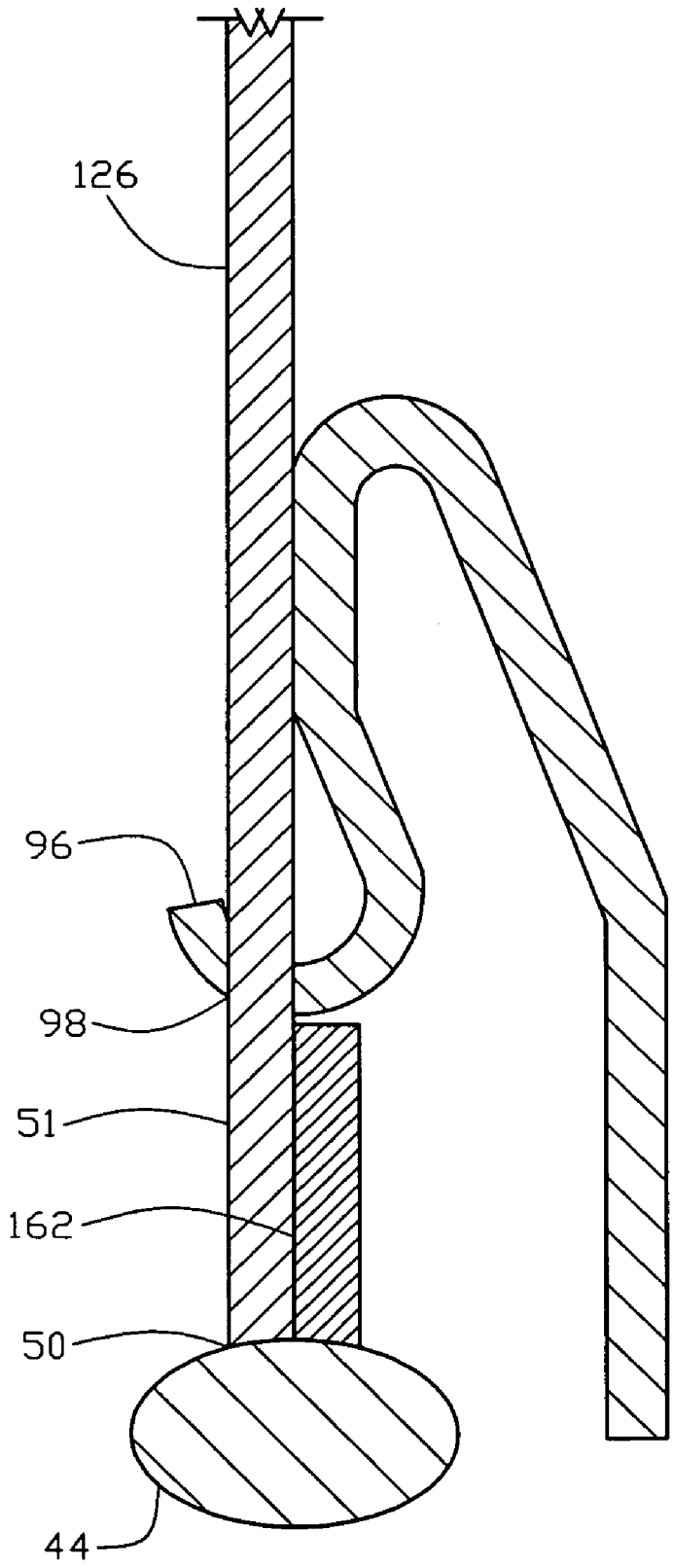
FIG. 8 shows sectional view 8-8 from FIG. 7 for an alternative embodiment of a flexible rod cross section with the attachment element.
Figure 9:
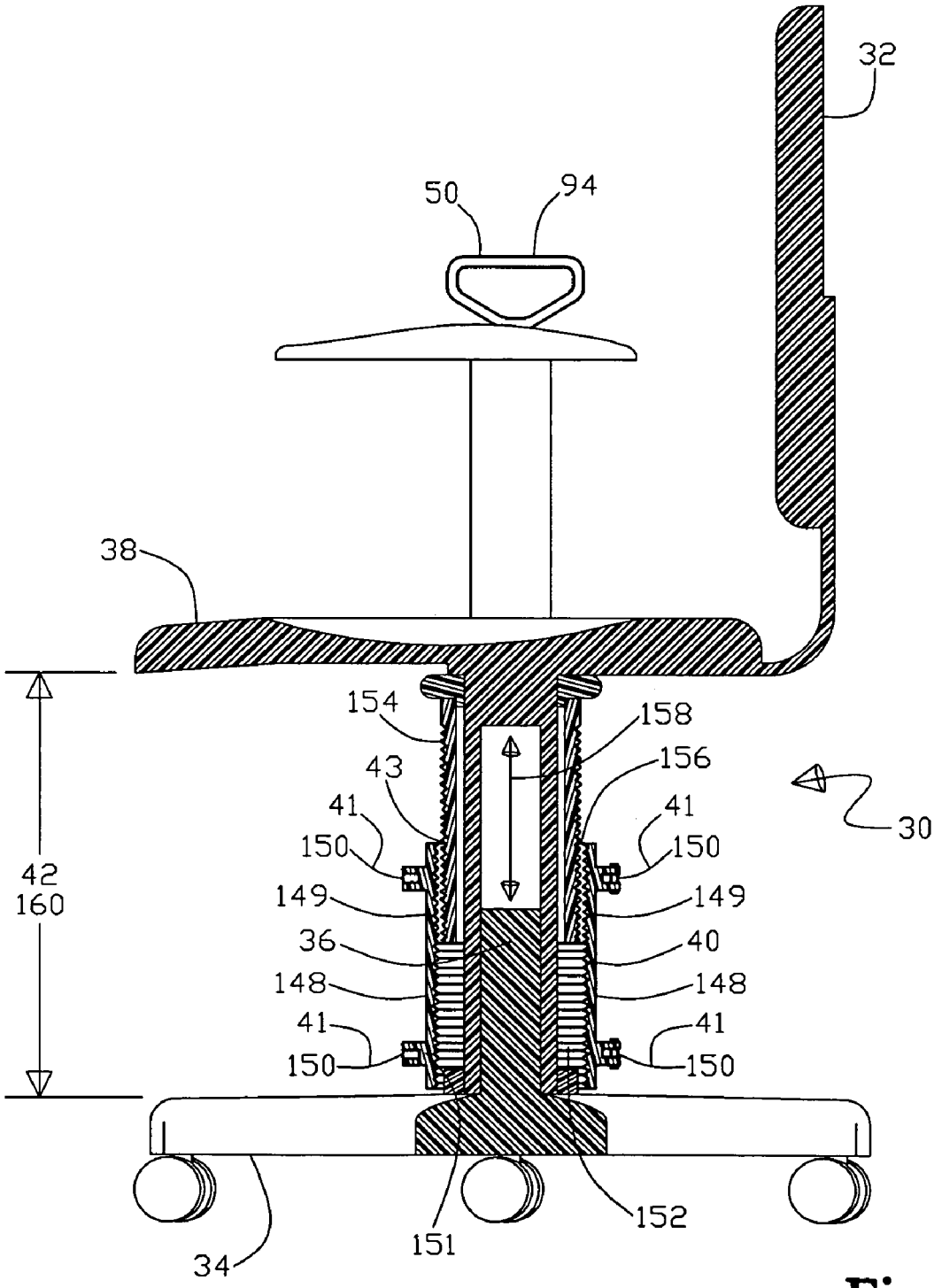
FIG. 9 shows sectional view 9-9 from FIG. 7 showing the chair pedestal, base, seat, and support structure interposed between the base and seat.

Broadly, with initial reference to FIG. 1 shown is a perspective view of the exercise apparatus 30, FIG. 2 also shows a perspective view of the exercise apparatus 30 denoting the expanded views of a selectively rotatable lockable socket 86 as shown in FIG. 3 and an attachment element 50 as shown in FIG. 4, with FIG. 3 showing an expanded perspective view of the selectively rotatable lockable socket 86 associated with the support structure 40, the base 34, and the resilient flexing rod 44. Continuing, FIG. 4 shows an expanded perspective view of the attachment element 50 associated with the resilient flexing rod 44, the strap 126, and structure 162 to rotatably 164 and pivotally 165 engage the rod 44 second end 48 to the attachment element 50. Further, FIG. 5 shows an exploded perspective view of the exercise apparatus 30, while FIG. 6 shows an exploded front view of the exercise apparatus 30, and FIG. 7 shows an assembled front view of the exercise apparatus 30. FIG. 8 shows sectional view 8-8 from FIG. 7 for an alternative embodiment of a flexible rod 44 cross section substantially in the form of an ellipse 89 with the attachment element 50, with FIG. 9 showing sectional view 9-9 from FIG. 7 that denotes the chair 32 pedestal 36, pedestal 36 lengthwise axis 37, base 34, seat 38, seat 38 outer margin portion 39, and support structure 40 that is interposed between the base 34 and seat 38.

Figure 10:
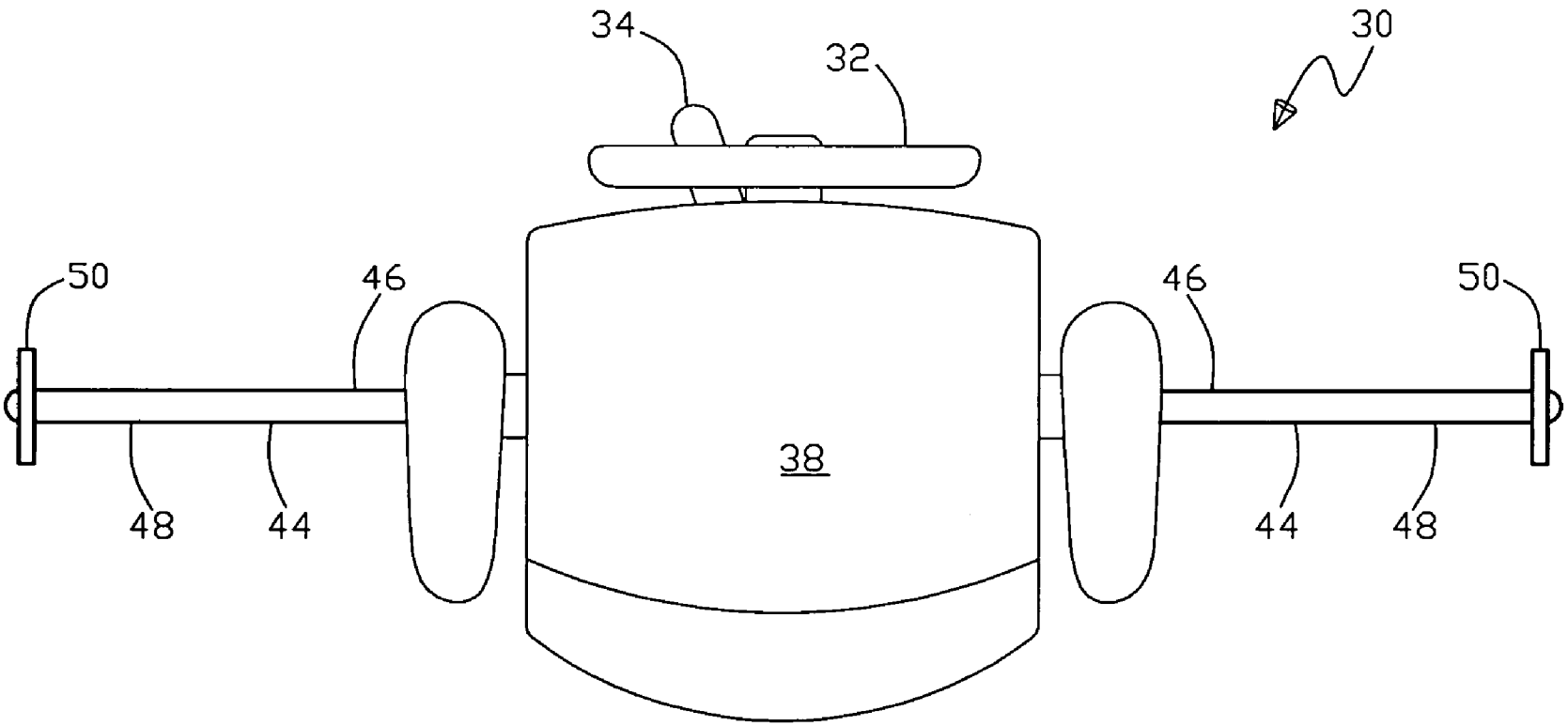
FIG. 10 shows an assembled top view of the exercise apparatus.
Figure 11:
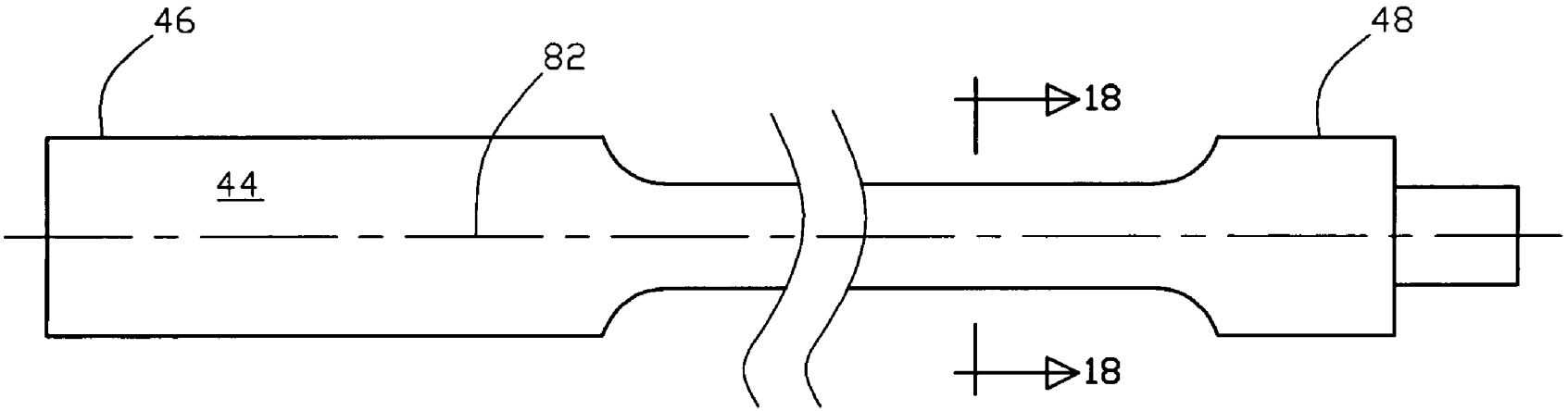
FIG. 11 shows a top view of the flexible rod with a non symmetric cross section.
Figure 12:
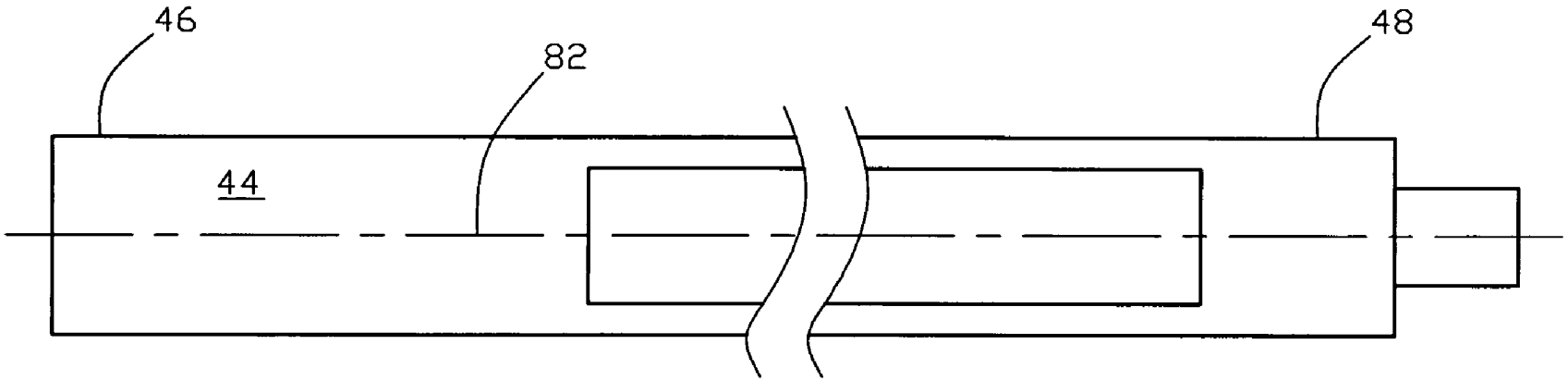
FIG. 12 shows a side view of the flexible rod with the non symmetric cross section as shown in FIG. 11.
Figure 13:
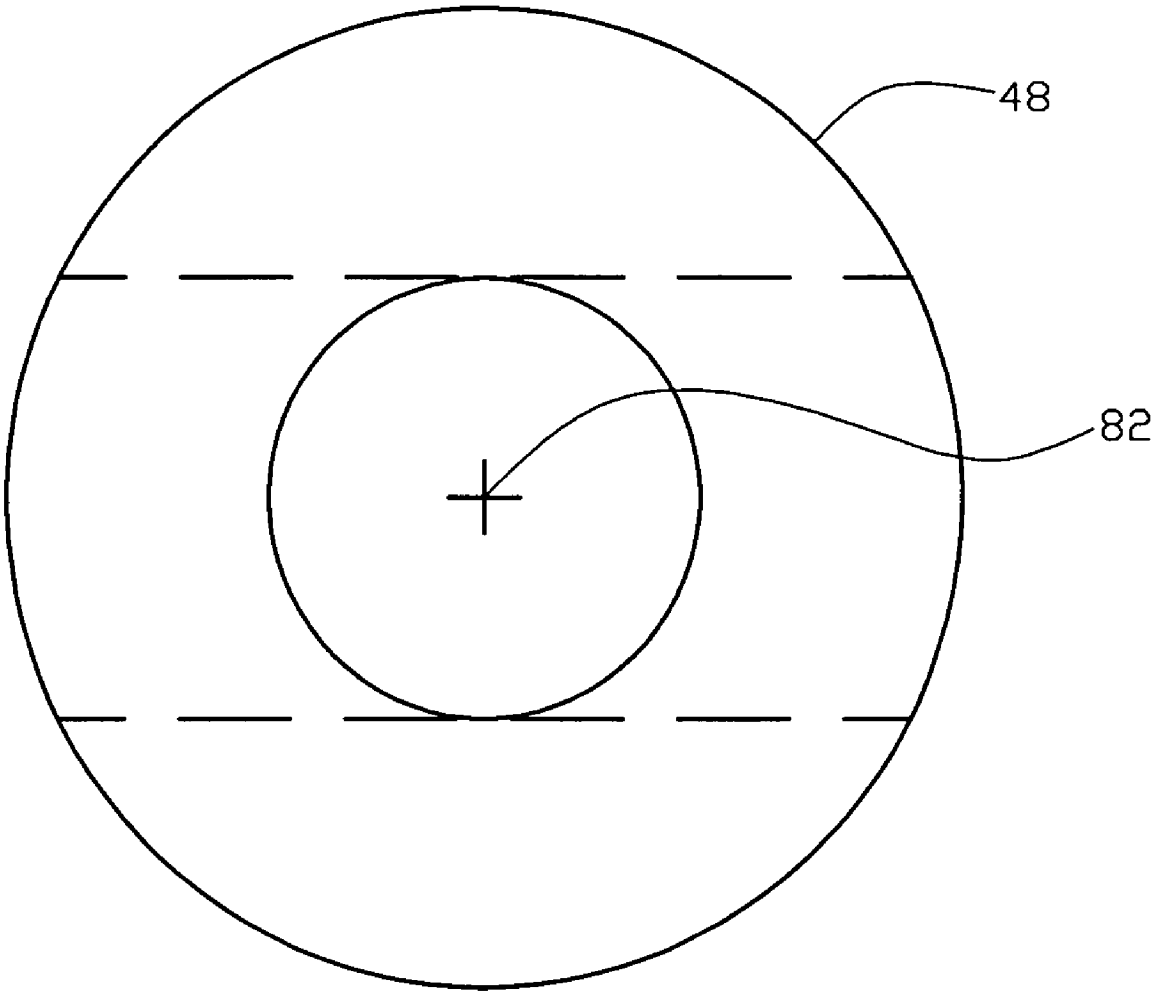
FIG. 13 shows an end view of the flexible rod second end distal portion as shown in FIG. 11.
Figure 14:
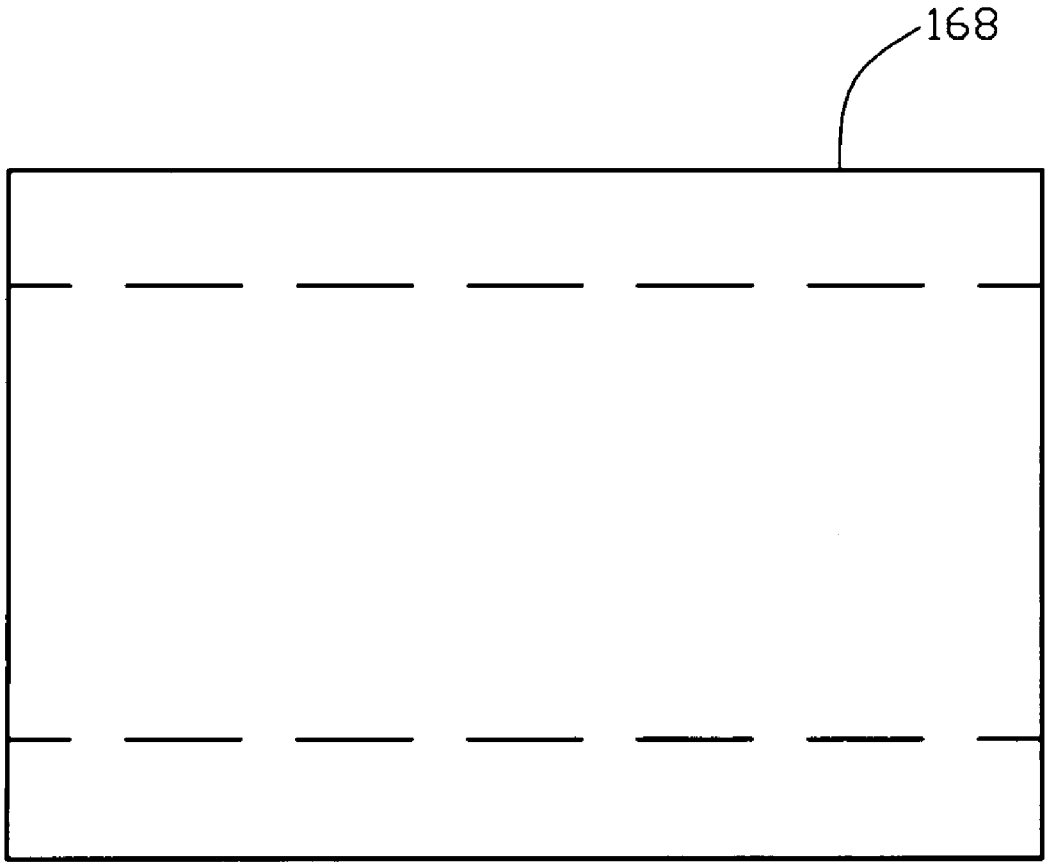
FIG. 14 shows a side view of the distal end fitting for the flexible rod second end distal portion.
Figure 15:
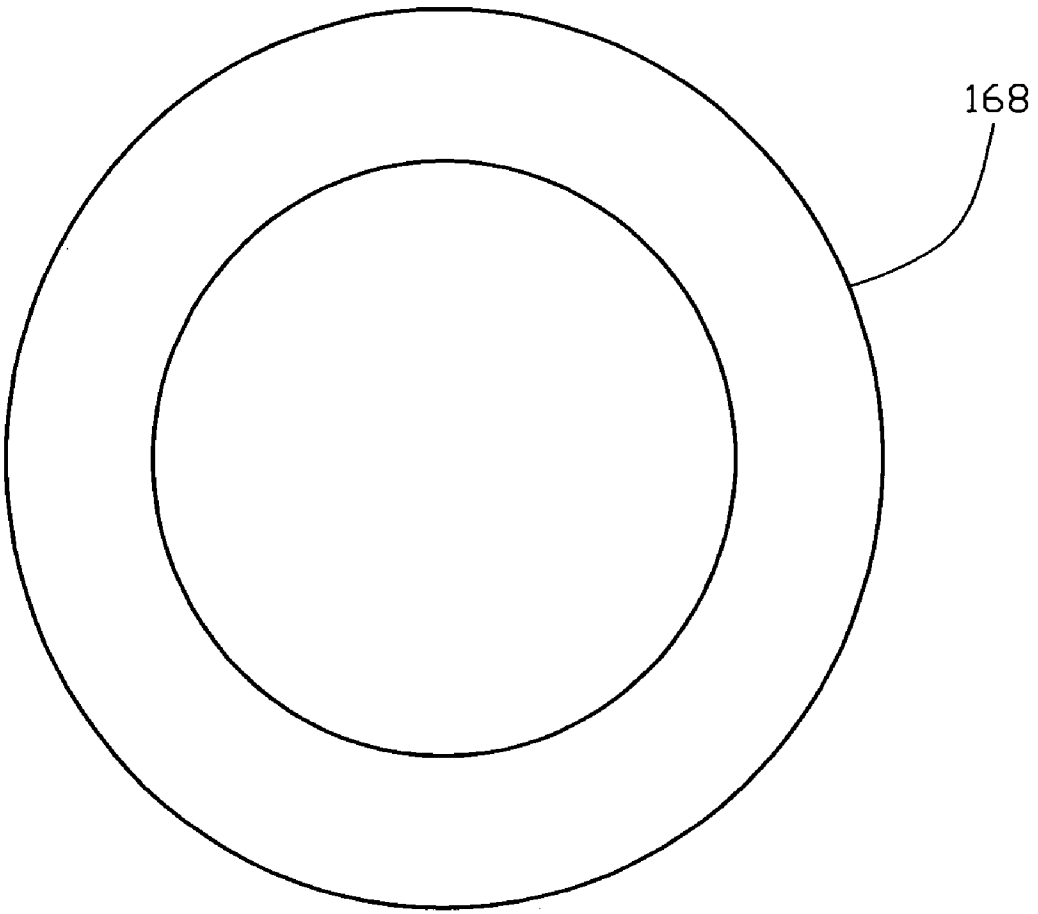
FIG. 15 shows an end view of the distal end fitting for the flexible rod second end distal portion.
Figure 16:
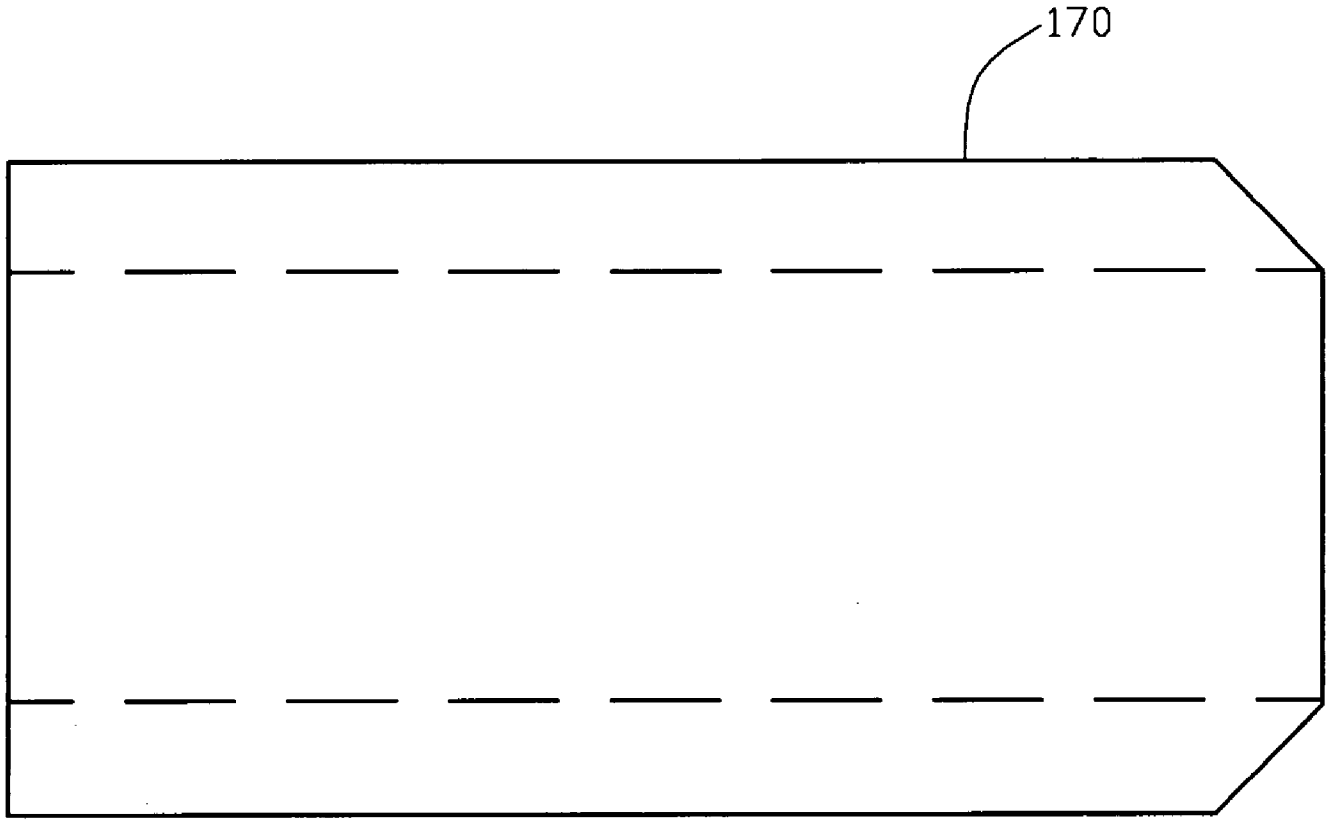
FIG. 16 shows a side view of a proximal end fitting for the flexible rod first end proximal portion.
Figure 17:
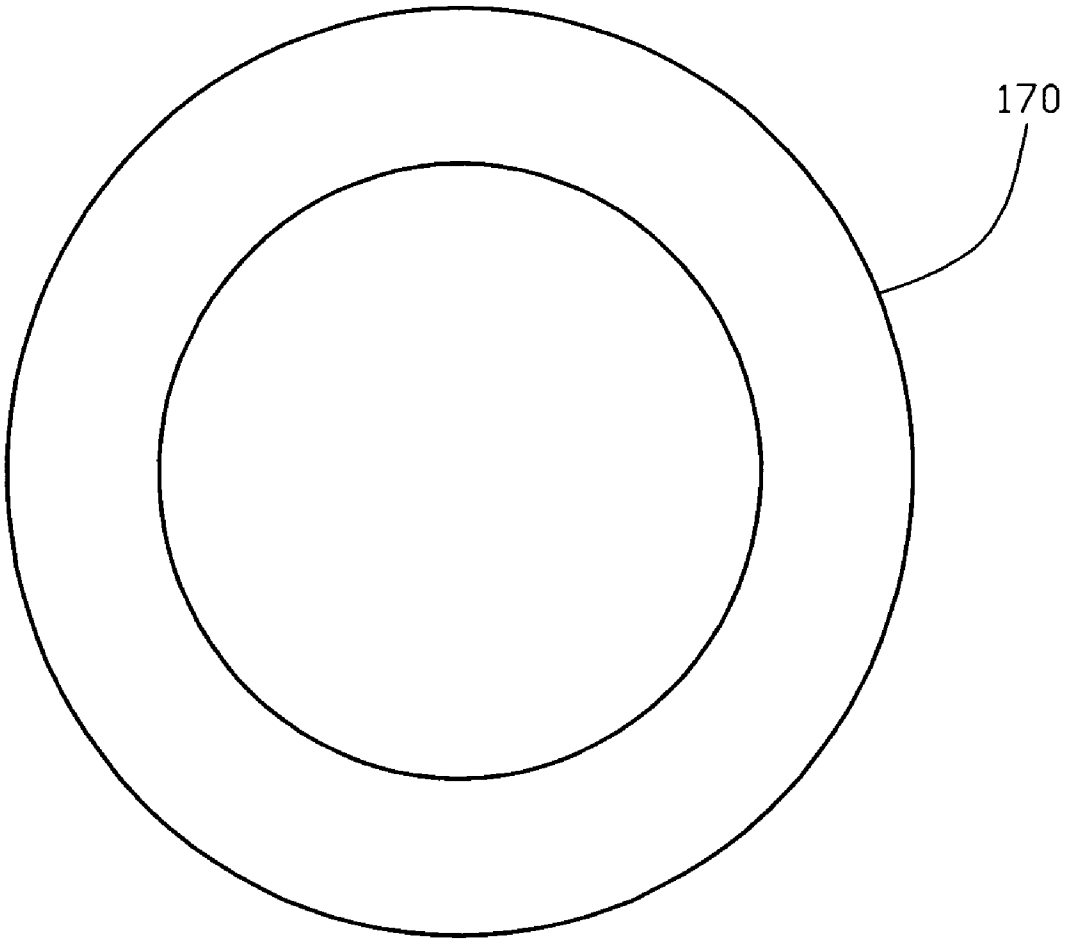
FIG. 17 shows an end view of the proximal end fitting for the flexible rod first end proximal portion.
Figure 18:
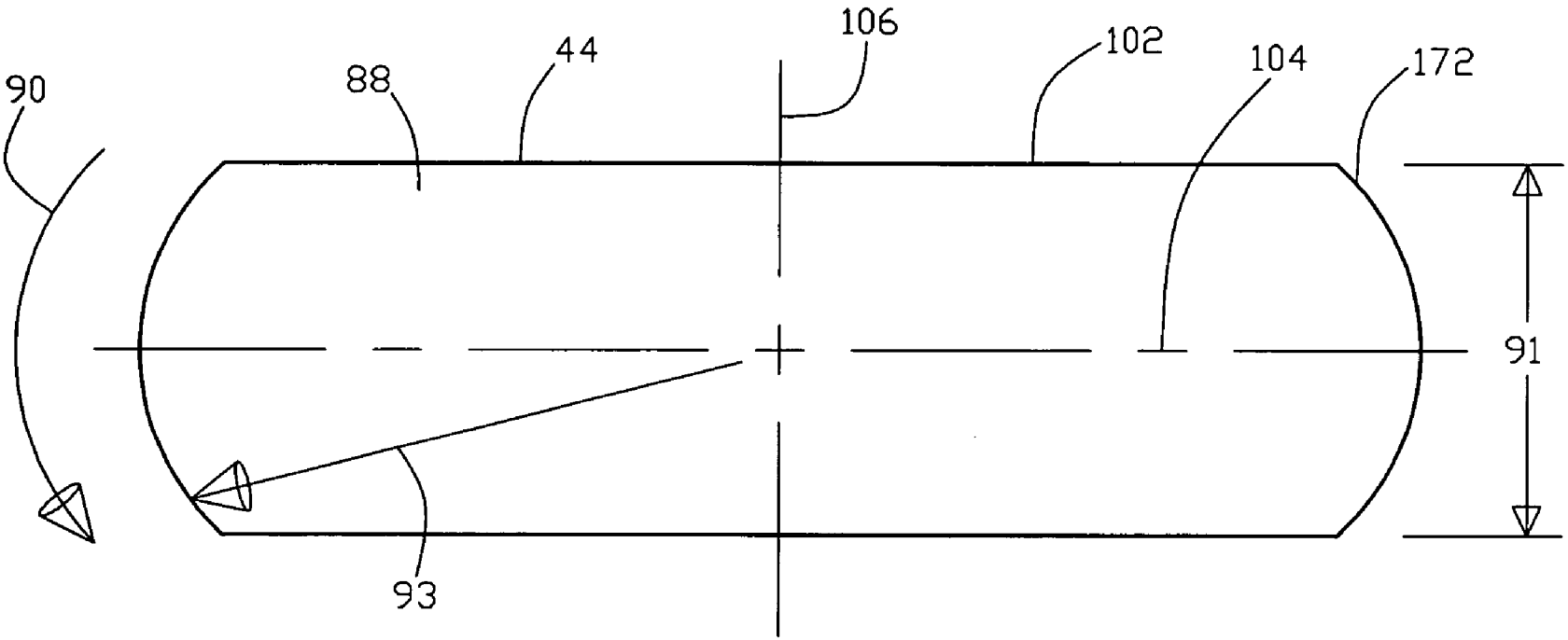
FIG. 18 shows section 18-18 from FIG. 11 for the cross section of the non symmetric flexible rod cross section substantially in the form of a rectangle.
Figure 19:
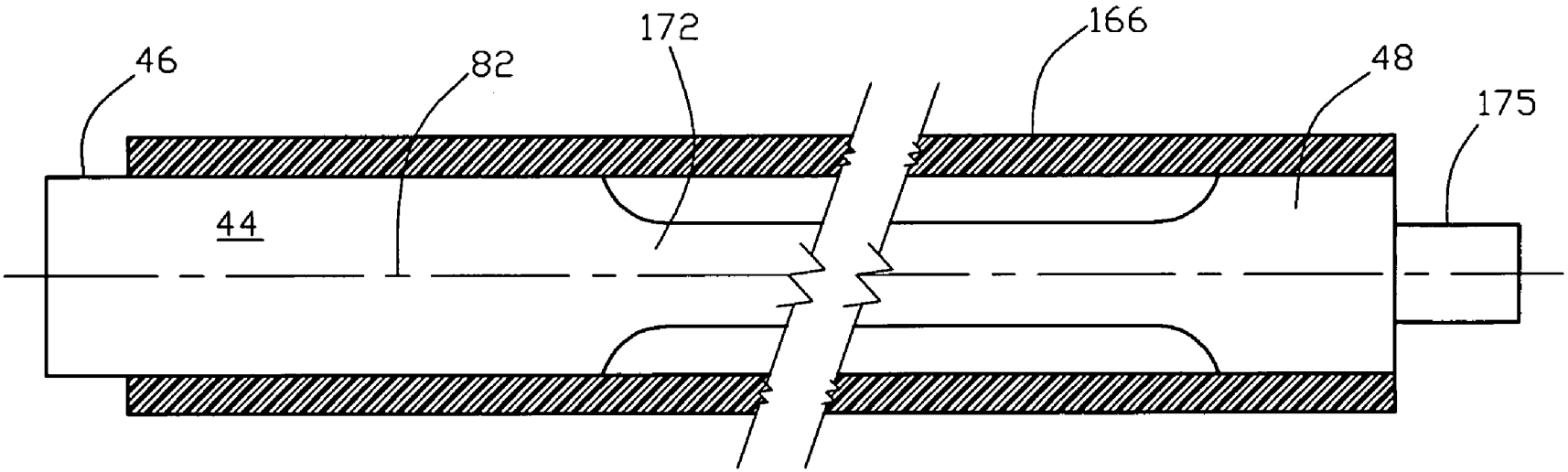
FIG. 19 shows a top view of the flexible rod with the non symmetric cross section substantially in the form of a rectangle with a stiffening sleeve slidably engaged.
Figure 20:
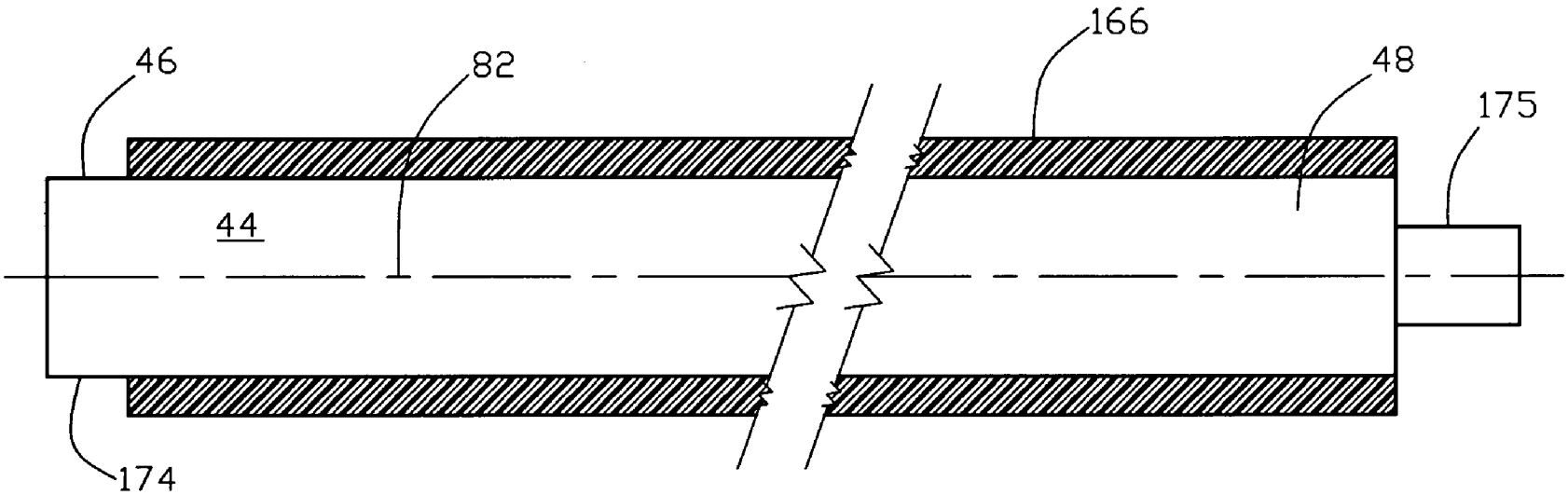
FIG. 20 shows a side view of the flexible rod having the symmetric cross section with the stiffening sleeve slidably engaged.

Further continuing, FIG. 10 shows an assembled top view of the exercise apparatus 30, FIG. 11 shows a top view of the flexible rod 44 with a non symmetric cross section substantially in the form of a rectangle 88, with FIG. 12 showing a side view of the flexible rod 44 again with the non symmetric cross section substantially in the form of a rectangle 88 as shown in FIG. 11. Yet, further FIG. 13 shows an end view of the flexible rod 44 second end distal portion 48 as shown in FIG. 11 and FIG. 14 shows a side view of the distal end fitting 168 for the flexible rod 44 second end distal portion 48. Moving to FIG. 15 shown is an end view of the distal end fitting 168 for the flexible rod 44 second end distal portion 48, FIG. 16 shows a side view of a proximal end fitting 170 for the flexible rod 44 first end proximal portion 46, and FIG. 17 shows an end view of the proximal end fitting 170 for the flexible rod 44 first end proximal portion 46. Next, FIG. 18 shows section 18-18 from FIG. 11 for the cross section of the non symmetric flexible rod 44 cross section substantially in the form of a rectangle 88, FIG. 19 shows a top view of the flexible rod 44 with the non symmetric cross section substantially in the form of a rectangle 88, with the stiffening sleeve 166 slidably engaged to the outer surface 172, and FIG. 20 shows a side view of the flexible rod 44 having the symmetric cross section 85 with the stiffening sleeve 166 slidably engaged to the outer surface 174.

Figure 21:
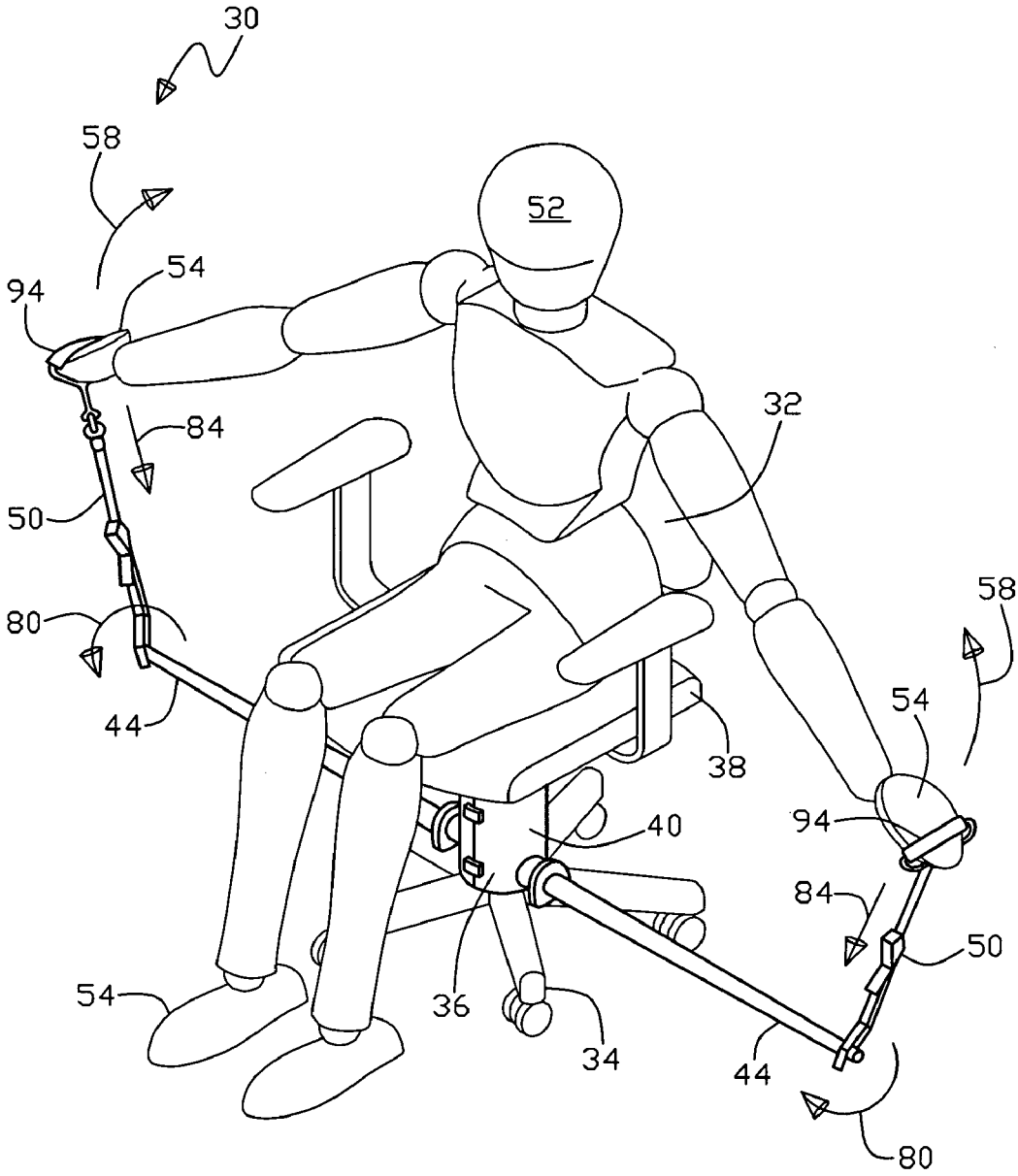
FIG. 21 shows a front perspective view of the exercise apparatus in use for a butterfly type exercise.
Figure 22:
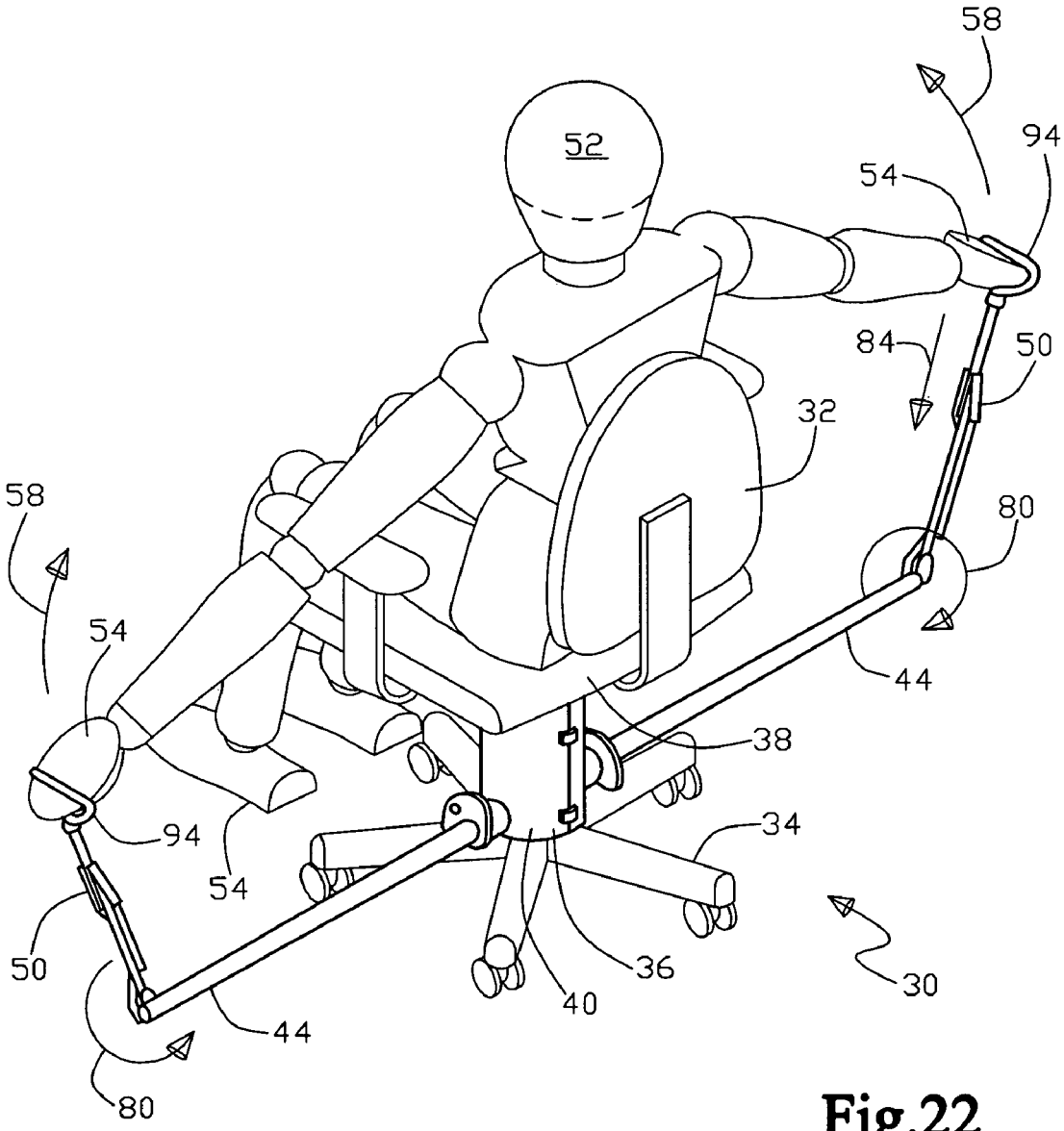
FIG. 22 shows a rear perspective view of the exercise apparatus in use for a butterfly type exercise.
Figure 23:
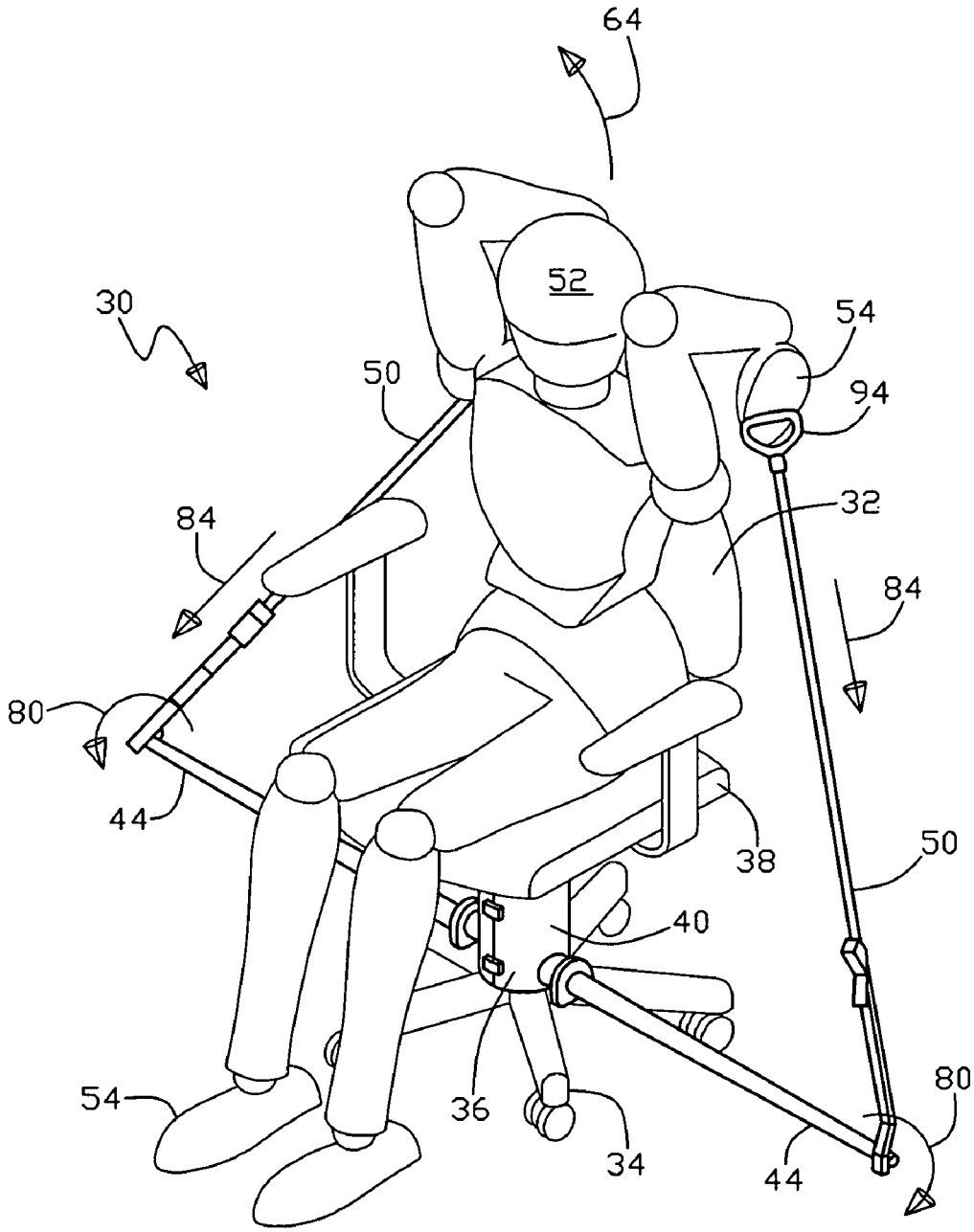
FIG. 23 shows a front perspective view of the exercise apparatus in use for a triceps type exercise.
Figure 24:
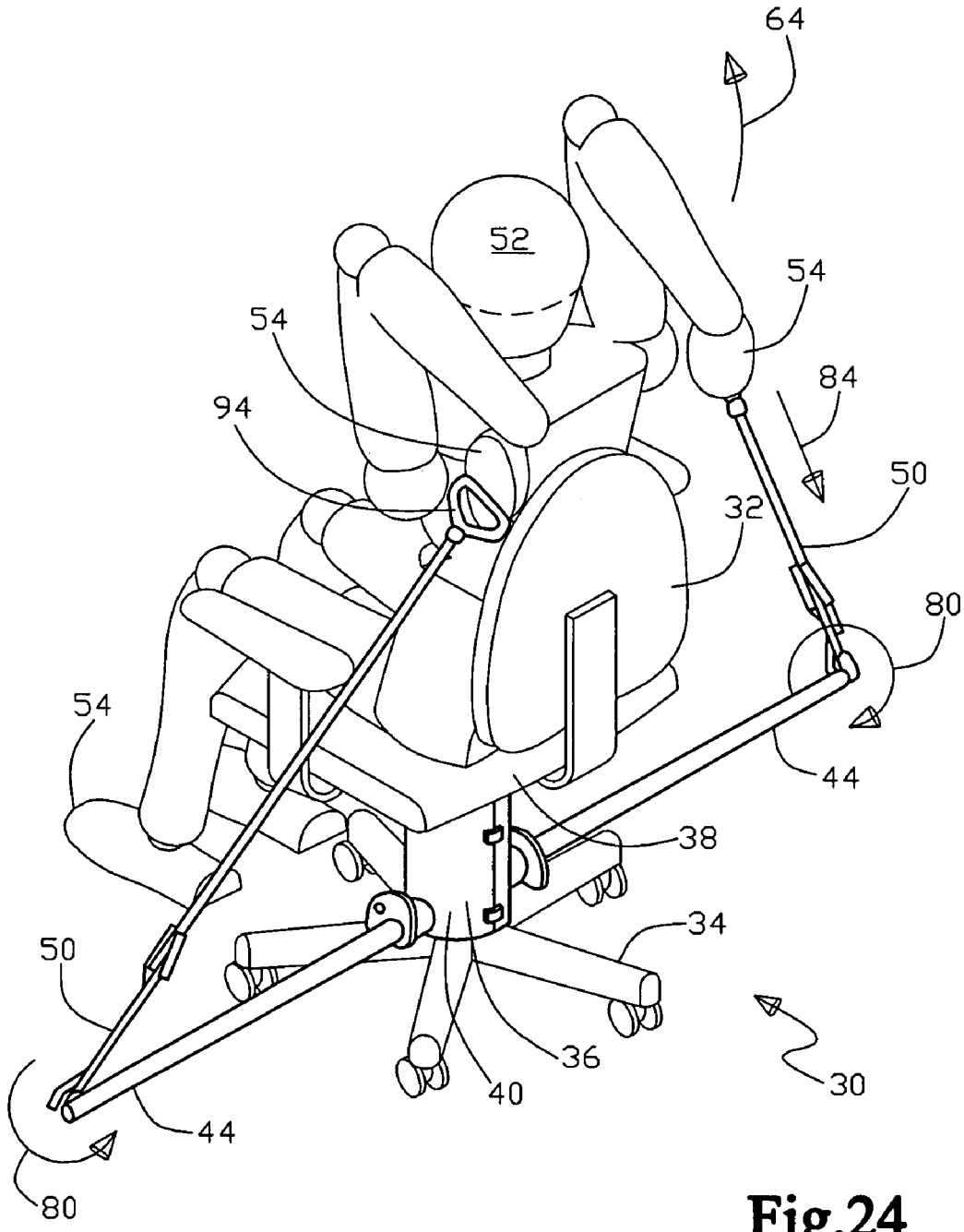
FIG. 24 shows a rear perspective view of the exercise apparatus in use for a triceps type exercise.
Figure 25:
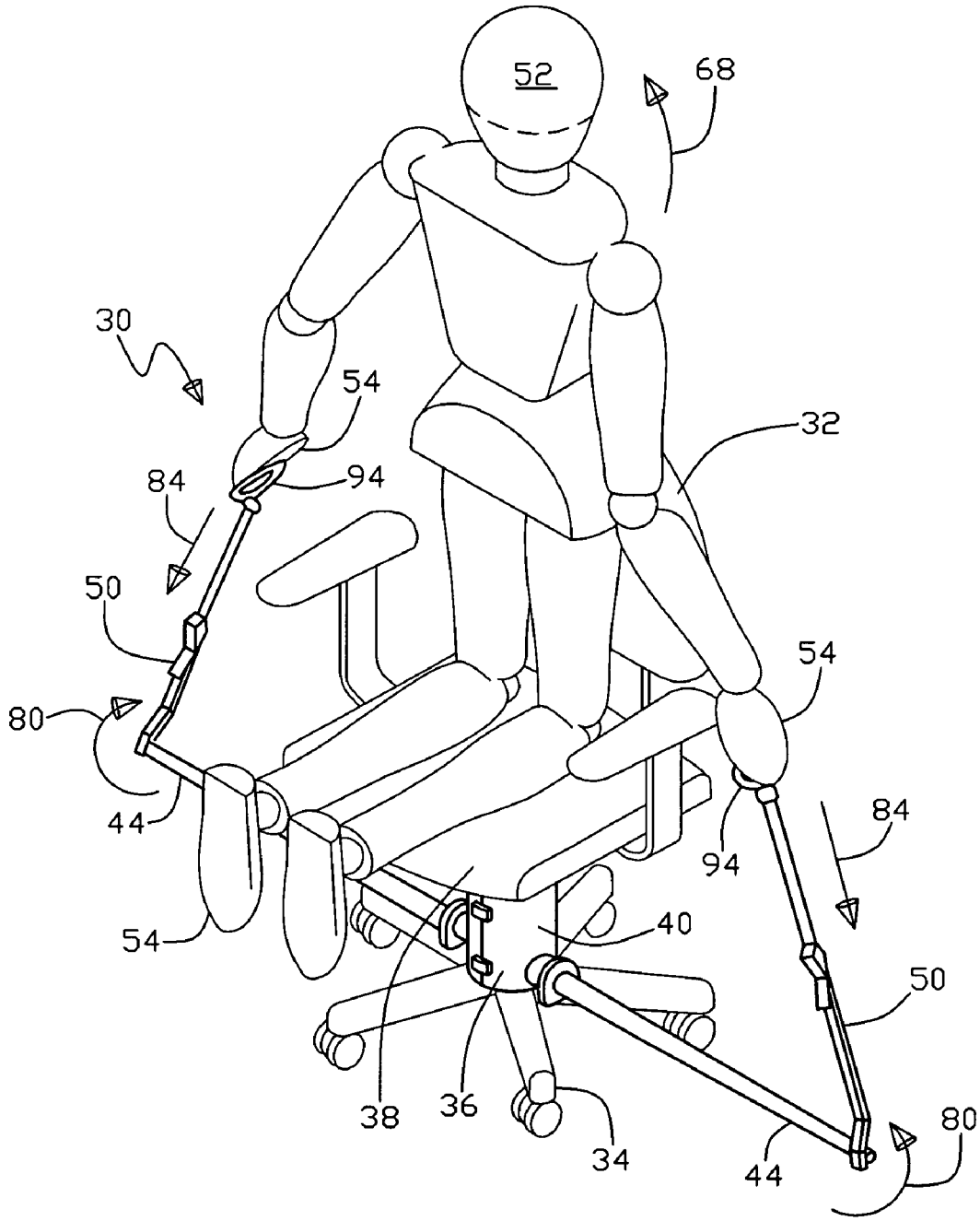
FIG. 25 shows a front perspective view of the exercise apparatus in use for a shoulder shrug type exercise.
Figure 26:
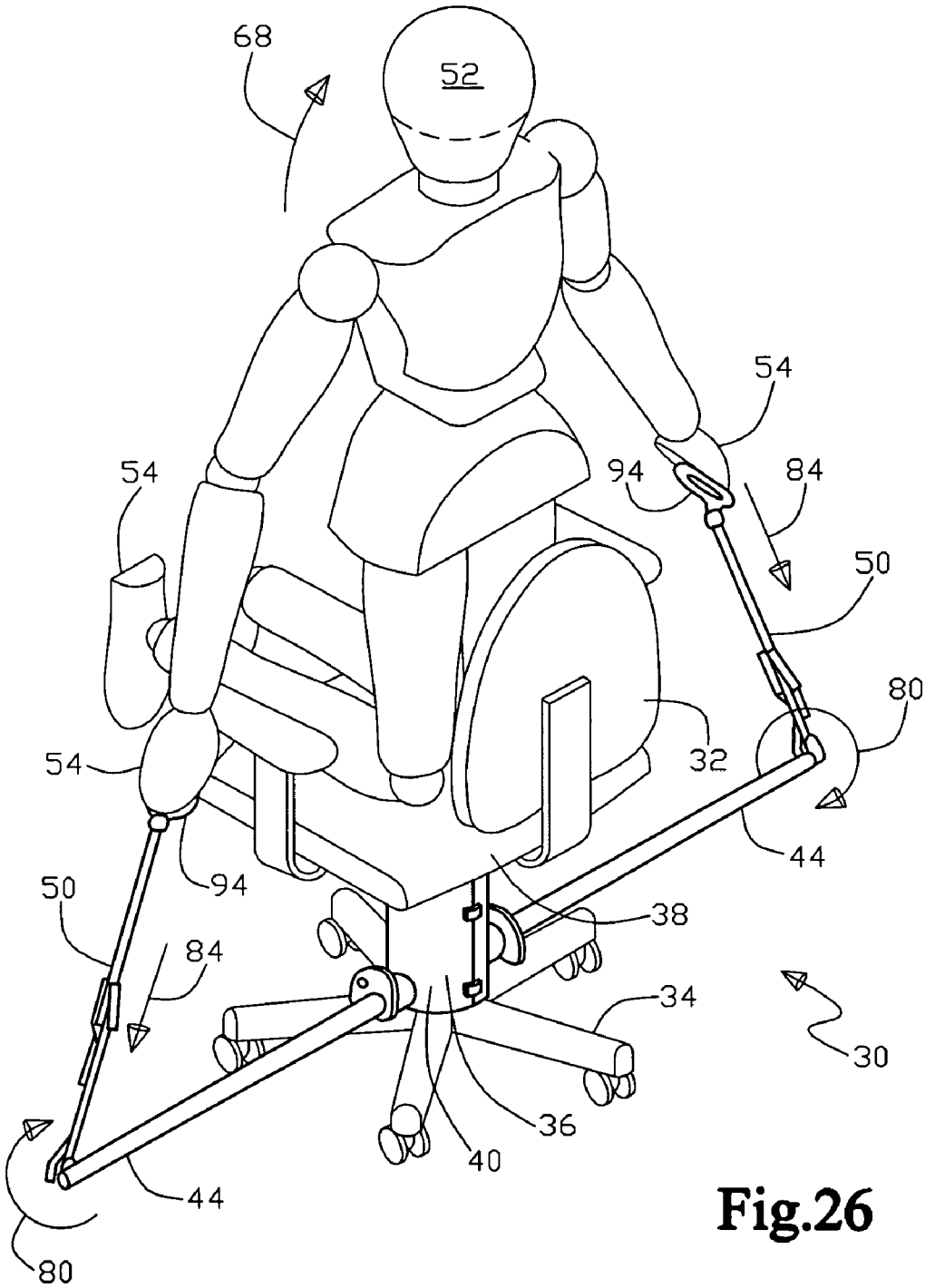
FIG. 26 shows a rear perspective view of the exercise apparatus in use for a shoulder shrug type exercise.
Figure 27:
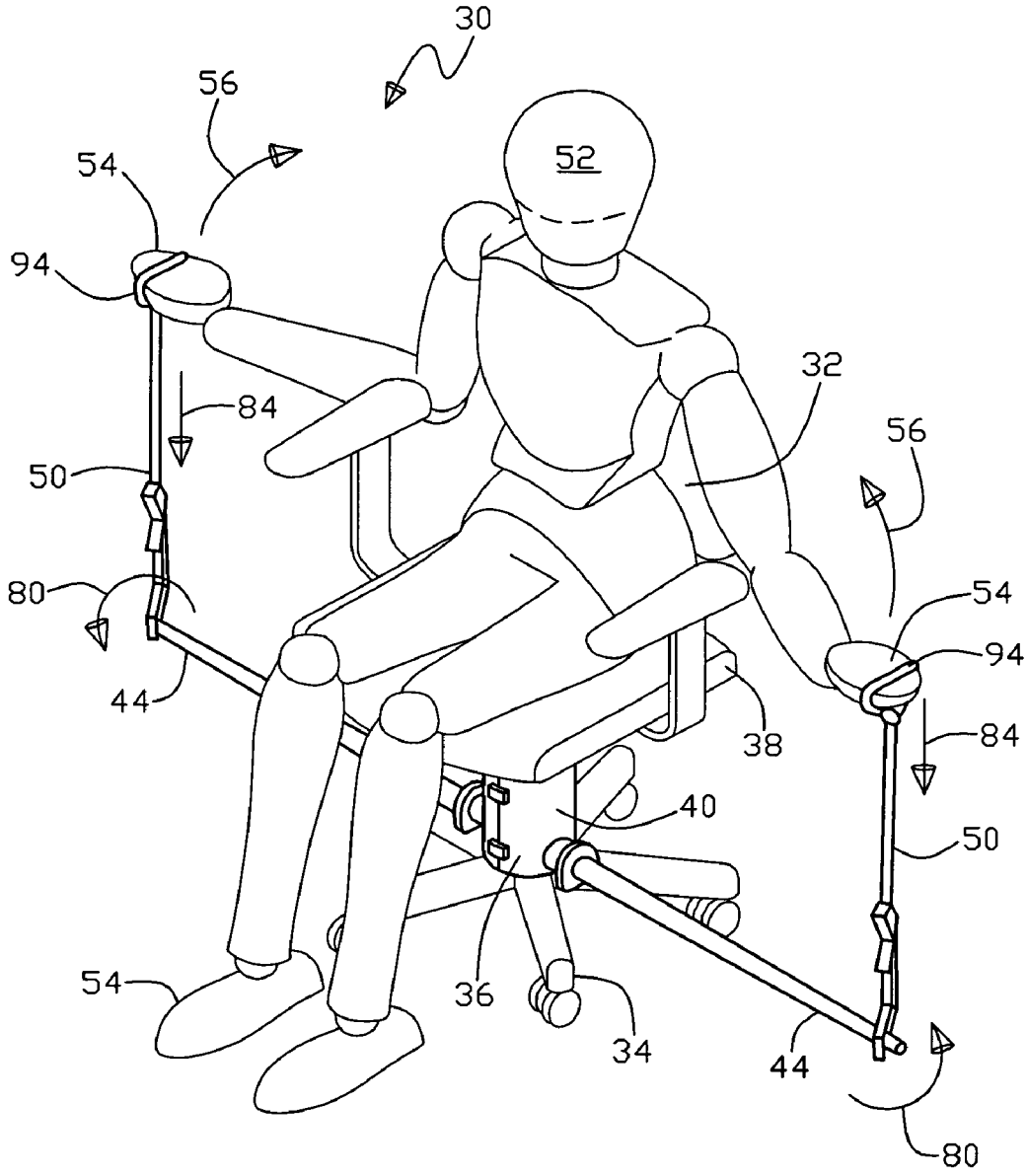
FIG. 27 shows a front perspective view of the exercise apparatus in use for a curling type exercise.
Figure 28:
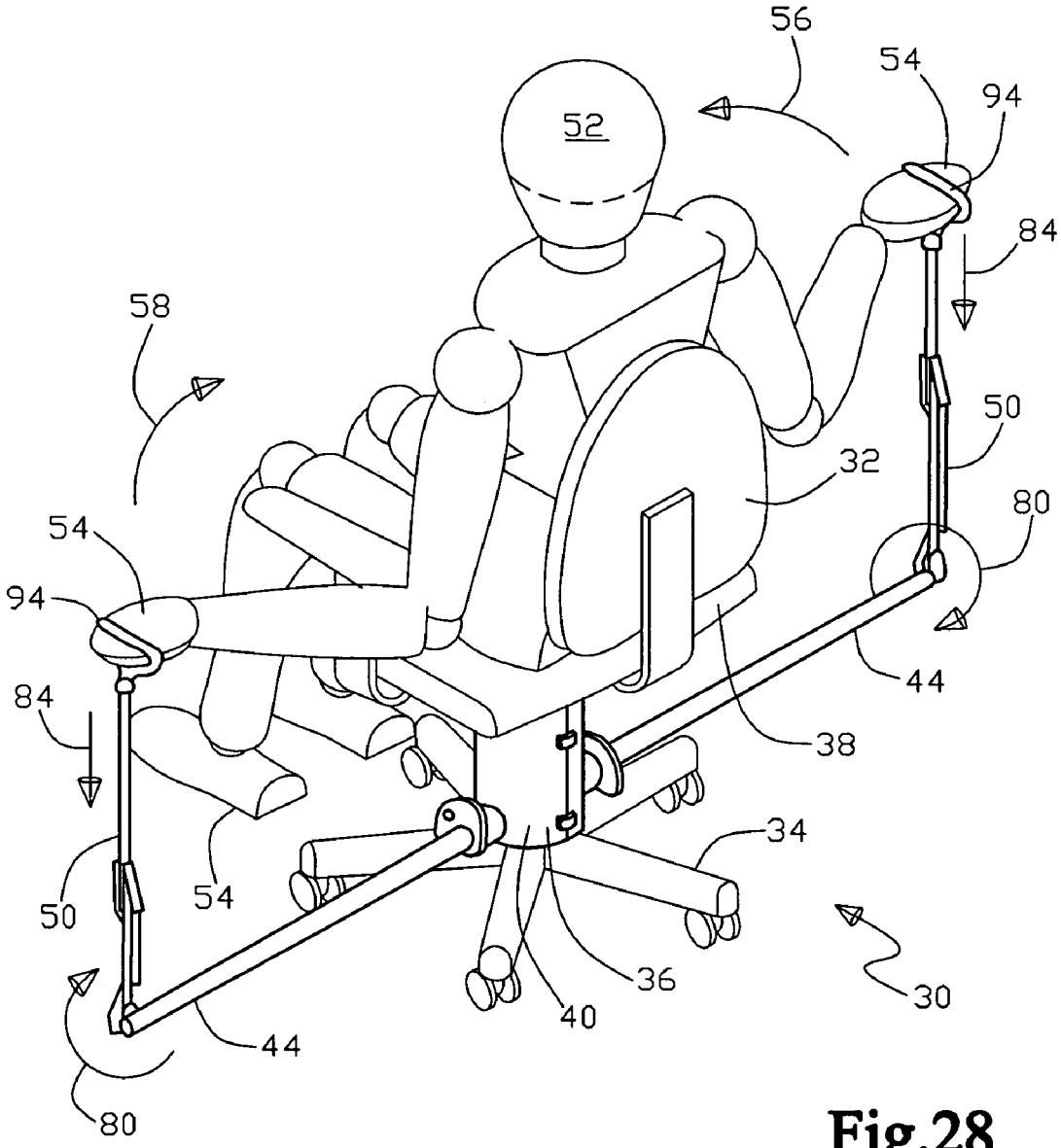
FIG. 28 shows a rear perspective view of the exercise apparatus in use for a curling type exercise.

Continuing, FIG. 21 shows a front perspective view of the exercise apparatus 30 in use for a butterfly 58 type exercise by an exercising human 52, FIG. 22 shows a rear perspective view of the exercise apparatus 30 in use for the butterfly 58 type exercise by the exercising human 52, and FIG. 23 shows a front perspective view of the exercise apparatus 30 in use for a triceps 64 type exercise by the exercising human 52. Further continuing, FIG. 24 shows a rear perspective view of the exercise apparatus 30 in use for the triceps 64 type exercise by the exercising human 52, FIG. 25 shows a front perspective view of the exercise apparatus 30 in use for a shoulder shrug 68 type exercise by the exercising human 52, and FIG. 26 shows a rear perspective view of the exercise apparatus 30 in use for the shoulder shrug 68 type exercise by the exercising human 52. Next, FIG. 27 shows a front perspective view of the exercise apparatus 30 in use for a curling 56 type exercise by the exercising human 52 and FIG. 28 shows a rear perspective view of the exercise apparatus 30 in use for the curling 56 type exercise by the exercising human 52.

Broadly, in referring to FIGS. 1 to 20, the present invention of an exercise apparatus 30 is for use with a chair 32, the chair 32 having a base 34, a pedestal 36 having a lengthwise axis 37, and a seat 38 having an outer margin portion 39, with the exercise apparatus 30 including a support structure 40 that is adapted to removably attach to the chair 32 pedestal 36. In addition, the support structure 40 is also to be substantially adjustably interposed between the chair 32 base 34 and the chair 32 seat 38, with the support structure 40 sized and configured to be secured to the pedestal 36 normal to the lengthwise axis 37, with the preferred purpose being to adjustably restrict movement of the support structure 40 as between the base 34 and the seat 38, thus helping to restrict the support structure 40 moving in relation to the pedestal 36 in a limited manner. Also included in the exercise apparatus 30 is a flexible resilient rod 44 having a first end proximal portion 46 and a second end distal portion 48, with the rod first end proximal portion 46 positioned adjacent to the support structure 40 in a cantilevered configuration (as best shown in FIG. 1) with the rod second end distal portion 48 free to flex in an omni directional 80 manner (in referring to FIGS. 21 to 28). Further included in the exercise apparatus 30 is an attachment element 50 that is adjacent to the rod second end 48, wherein the attachment element 50 is adapted to removably engage to a portion of human 52 anatomy 54 for the purpose of exercise by omni directional flexing 80 of the rod 44 along its length, referring to a lengthwise axis 82, thus causing a resistive force 84 at the attachment element 50 for the purpose of exercise by the human 52.

Optionally, the exercise apparatus 30 support structure 40 can include a selectively rotatably lockable socket 86 that is sized and configured to rotationally receive the rod 44 first end portion 46, as best shown in FIG. 3, wherein the socket 86 facilitates rotational movement 90 of the rod 44 substantially about the rod 44 longitudinal axis 82 by the socket 86 rotating about its axis 87, wherein axis 87 and axis 82 are substantially parallel but not necessarily co-axial. Further, the selectively rotatably lockable socket 86 includes a disk 140 affixed to the support structure 40 that has a plurality of apertures 142 and an extension 144 affixed to the selectively rotatable lockable socket 86, wherein the extension 144 removably engages the apertures 142 through a manual removable engagement 146 that is operational to selectively secure the selectively rotatable lockable socket 86 at a particular rotational position 145, thus resulting in the rod 44 rotation 90 being secured at a particular rotational position. In referring to FIGS. 21 to 28 the preferred purpose of the rod 44 rotation 90 is to allow for the desired benefit of variable rod 44 flexing or movement 80 resistance thus resulting in variable exercise resistive force 84 for the human 52 to accommodate a larger number of exercises that would be possible, without the need for using different rods 44 for different flexing or exercise resistive force 84 levels. Additionally, the exercise apparatus 30 can optionally have a plurality of selectively rotatable lockable sockets 86 and/or rods 44 adjacent to the support structure 40, with the plurality of sockets 86 and/or rods 44 being operational to further increase the number of exercises accommodated on the exercise apparatus 30.

To eliminate the need for using different rods 44 for different flexing or exercise resistive force 84 levels, the use of a rod 44 that can have various a non symmetric cross sections, referring specifically to FIGS. 8, 11, 12, and 18 is employed. Thus, when the rod 44 is rotated about its axis 82 the bending area moment of inertia changes, due to the rod 44 bending plane which would be substantially parallel to the resistive force 84 (see FIGS. 12-28) such that the rod 44 bending plane is changing in its relationship to the non symmetrical cross section of the rod 44. As an example in looking specifically at FIG. 18, if the rod 44 bending plane was substantially parallel to the major axis 104 the rod 44 flexing strength would be higher and if the rod 44 bending plane was substantially parallel to the minor axis 106 the rod 44 flexing strength would be lower. This rod 44 flexing strength can be defined as a mathematical relationship for a defined non symmetric cross section, as an example in FIG. 18, starting with a round rod 44 of radius 93 wherein the rod 44 had shaved sides that result in a substantially rectangular 102 cross section, with the shaved sides resulting in thickness 91 being the cross sectional distance along the minor axis 106 with two times the radius 93 being the cross sectional distance along the major axis 104. Thus, for the non symmetric rod 44 cross section as previously defined in FIG. 18 the thickness 91 equals two times the radius 93 divided by the square root of the ratio of bending stiffness desired, which is the maximum differential between the rod 44 flexing strength by bending in a plane substantially parallel to the minor axis 106 (minimal flexing strength of the rod 44) and major axis 104 (maximum flexing strength of the rod 44). As an example, if the radius 93 equals one inch, and the desired stiffness ratio is five (meaning that the rod 44 is five times as strong bending along the major axis 104 as opposed to bending along the minor axis 106) the calculated thickness 91 is equal to about nine-tenths of an inch, or the non symmetric cross section has a ratio of about two between the non symmetric cross section along the major axis 104 to the non symmetric cross section along the minor axis. Note that the aforementioned equation relationship is irrespective of the materials of construction used, as the equation is geometric in nature. Although FIGS. 1 to 7 and 21 to 28 show the rod 44 somewhat tapered from the first end 46 to the second end 48, the rod 44 can also be non tapered.

The preferred materials of construction for the rod 44 are DuPont DELRIN acetyl resin, specifically being part number 570 NC000 that is a twenty percent glass filled acetyl, other acceptable acetyls would include acetyl copolymers, DELRIN homopolymers, DELRIN AF PTFE filled, or various other materials such as nylon, fiberglass, composites, and plastics, or even spring steels that can exhibit the properties of flexing repetitively in the range of motion or omni directional movement 80 up to about one-hundred pounds of exercise resistive force 84 created at the attachment element 50 from the rod 44 flexing. In referring to FIGS. 14-17, to better accommodate the rod 44 preferred materials of construction, the rod 44 first end proximal portion 46 preferably uses the proximal end fitting 170 that engages the outer surface 172 or 174 of either the non symmetric or symmetric rod 44 respectively to protect the rod 44 preferred materials of construction while the rod 44 first end 46 is received in the socket 86. Also, correspondingly the rod 44 second end distal portion 48 uses the distal end fitting 168 that engages the outer surface 175 of the rod 44 second end distal portion 48 to protect the rod 44 preferred materials of construction at the attachment element 50 interface with the rod 44 second end distal portion 48. The preferred materials of construction for the distal end fitting 168 and the proximal end fitting 170 are aluminum or any other alternative material that would meet the aforementioned functional requirements.

Therefore, in still referring to FIG. 18 in using the above example the maximum difference available between the maximum and minimum exercise force 84 is five, thus when the rod 44 is rotated 90 to having a bending plane intermediate to the major axis 104 and the minor axis 106, of necessity the rod 44 bending or flexing strength and thus exercise force 84 will be in between the maximum and minimum exercise force 84 of five to one, such that as an example the minimum exercise force 84 is ten pounds force and the maximum exercise force 84 in fifty pounds force. The intermediate exercise force 84 can be calculated by applying the parallel axis theorem in engineering statics to the rod 44 as a beam, wherein the bending plane is at a position intermediate to the major axis 104 and the minor axis 106 with the rod 44 non symmetric cross section subdivided into sections parallel to the bending plane, with an area moment of inertia calculated for each section, then adding the section inertias by the parallel axis theorem to obtain a composite area moment of inertia for the non symmetric cross section at a bending plane in between the major axis 104 and the minor axis 106 per normal engineering standards. Through normal statics engineering calculations once the composite area moment of inertia is known, then various stresses, forces, and deflections can be calculated for the rod 44. Accordingly, the rod 44 is rotatable 90 about its lengthwise axis 82 through the socket 86 being operational to allow for selected different resistive forces 84 at the attachment element 50 by varying the rod 44 effective area bending moment of inertia in relation to the rod 44 flexing along its length. Thus, in summary the non symmetric cross section rod 44 allows for the same rod 44 to be able to have different flexing strengths, that results in different variable exercise resistive forces 84 by utilizing the rotatable locking socket 86 that allows for a selected rod 44 rotational position 145 by the rod 44 rotating 90 about its longitudinal axis 82. Although the rod 44 non symmetric cross section substantially in the form of a rectangle 102 has been described, other non symmetric cross sections of the rod 44 can be utilized such as an ellipse (as shown in FIG. 8), or semi circular, triangular, or any other number of non symmetric cross sectional shapes for which area moment of inertia equations have been developed in engineering statics.

Further, the attachment element 50 is preferably a handgrip 94 and a selectively lengthwise adjustable extension 96 between the handgrip 94 and the rod 44 second end portion 48. The handgrip 94 is a conventional type as best shown in FIG. 1 and the lengthwise adjustable extension 96 is preferably a selectable lengthwise locking element 128 for a strap 126 in the form of a compression clamp 128 similar to a furniture strap or motorcycle tie down strap. Wherein the strap 126 is selectably adjustable lengthwise by manually pushing a lever that releases the compression clamp 128 allowing the strap 126 to freely move lengthwise and when the lever is manually released the clamp 128 "pinches" the strap to secure its lengthwise selected position. Alternatives for the lengthwise adjustable extension 96 would include double D rings, a belt type buckle, a hook and loop fastener, a fold over strap clamp, any other structure that can accomplish selectively securing the strap at a particular lengthwise position. Optionally, the selectively lengthwise adjustable extension 96 can selectively removably engage 98 from itself 51, preferably by way of a auto seatbelt type of lengthwise fastener or any other functional alternative that is operational to allow replacement of the handgrip 94 with a foot harness (not shown) for instance as is known in the art, wherein the foot harness or any other attachment element 50 to a portion of the human 52 anatomy 54 would preferably utilize the previously mentioned lengthwise adjustable extension 96 and the selectively lengthwise adjustable extension 96 that can selectively removably engage from itself 51 or any other alternative that would be functionally acceptable as also previously described. Another option for the attachment element 50 that is adjacent to the rod 44 second end portion 48 is to include structure to rotatably 164 and pivotally 165 engage the rod 44 second end 48 as best shown in FIG. 4. As the rod 44 while in use engages in rotational movement 90 and omni directional movement 80 from the rod 44 flexing along its length, having the attachment element 50 that is adjacent to the rod 44 second end 48 rotatably 164 and pivotally 165 engage the rod 44 second end 48 will help to keep the strap 126 straight regardless of the rod 44 movement as previously described. The structure to accomplish rotation 164 and pivot 165 can be conventional pins, collars and the like.

Returning to the support structure 40, in referencing FIGS. 1 to 7 and 9, the support structure 40 includes a removable attachment 41 is preferably in the form of a split clamshell 148 as best shown in FIGS. 5 to 7 and 9, the split clamshell 148 includes a pair of outer removably attachable semicircular lengthwise split 149 clamshell halves that are adjacent at a split line 149, including a plurality of quick release fasteners 150 that are also adjacent to the split line 149. With the clamshell 148 also including a split resilient liner 152 that is preferably made of a stiff yet resilient material, such as rubber, that is operational to substantially accommodate differing pedestal sizes and functionally keeping the support structure 40 substantially centered about the pedestal 36 to minimize the lateral "looseness" of the support structure 40 or the clamshell 148 in relation to the pedestal 36. In conjunction with the aforementioned lateral looseness minimization issue for the clam shell 148 to the pedestal 36, another issue is the vertical looseness of the support structure 40 between the base 34 and the seat 38, with the support structure 40 being about the pedestal 36 due to the varying distance 42 between the base 34 and the seat 38 wherein the desirable adjustable interposing 43 of the support structure 40 between the base 34 and the seat 38 to also minimize the vertical looseness of the support structure 40 to the chair 32 to better enable a higher number of multiple exercises to be performed with the exercise apparatus 30. The support structure 40 adjustable interposing 43 is preferably accomplished by use of an externally engaging substantially hollow lengthwise split shaped cylinder 154 that will include a cylindrical axis 155 positioned substantially radial to the lengthwise axis 37, the cylinder 154 is removably engaged 156 to an inner matably engaging surface 151 of the split clamshell 148 being operational to selectively adjust the support structure 40 telescopically lengthwise 37 to substantially match the variable distance 42 between the chair 32 base 34 and the chair 32 seat 38 allowing for the pedestal 36 movement along the lengthwise axis 37. Thus resulting in the support structure 40 that has the telescopic lengthwise adjustment 158 to substantially fill in the distance 42 between the base 34 and the seat 38 to minimize the vertical looseness of the support structure 40 to the chair 32 to better enable a higher number of multiple exercises to be performed with the exercise apparatus 30 as best shown in FIG. 9. Further, optionally structure could be added preferably in the form of an anti rotation pin 180 adjacent to the base 34, as shown in FIG. 1, wherein the pin 180 could be added to help prevent rotational movement 178 of the support structure 40 in relation to the pedestal 36 to add to the exercises that would be possible on the exercise apparatus 30. The materials of construction for the clamshell 148, cylinder 154, fasteners 150, pin 180, and selectively rotatably lockable socket 86 can be metals or composites that meet the aforementioned functional requirements, wherein the selectively rotatably lockable socket 86 is disposed on an exterior of the clamshell 148 as best shown in FIG. 3.

As an option to the previously described non symmetric cross section for the rod 44 to have the advantage of helping to have variable resistive force for exercise movement 84 with the use of a single rod 44, another option would be to utilize a flexible stiffening sleeve 166 as best shown in FIGS. 19 and 20 that slidably engages the outer surface 172 of the non symmetric rod 44, (see FIG. 19) or that slidably engages the outer surface 174 of the symmetric rod 44 (see FIG. 20). Note that the flexible stiffening sleeve 166 could slidably engage the outer surface of any cross sectional configuration rod 44 as previously mentioned such as other non symmetric cross sections of the rod 44 can be utilized such as an ellipse (as shown in FIG. 8), or semi circular, triangular, or any other number of non symmetric cross sectional shapes for which area moment of inertia equations have been developed in engineering statics, wherein the sleeve 166 could slidably engage any configuration of the outer surface of the rod. The flexible sleeve would be constructed of materials same as previously described for the rod 44, wherein the flexible sleeve 166 would add stiffness to the rod 44, thus reducing rod 44 flexing, thereby increasing the exercise resistive force 84 by adding to the bending area moment of inertia to the rod 44. A plurality of sleeves 166 could be used with varying wall thicknesses to further vary the range of rod 44 stiffness increases resulting in further varying the exercise resistive force 84.

Figure 300:
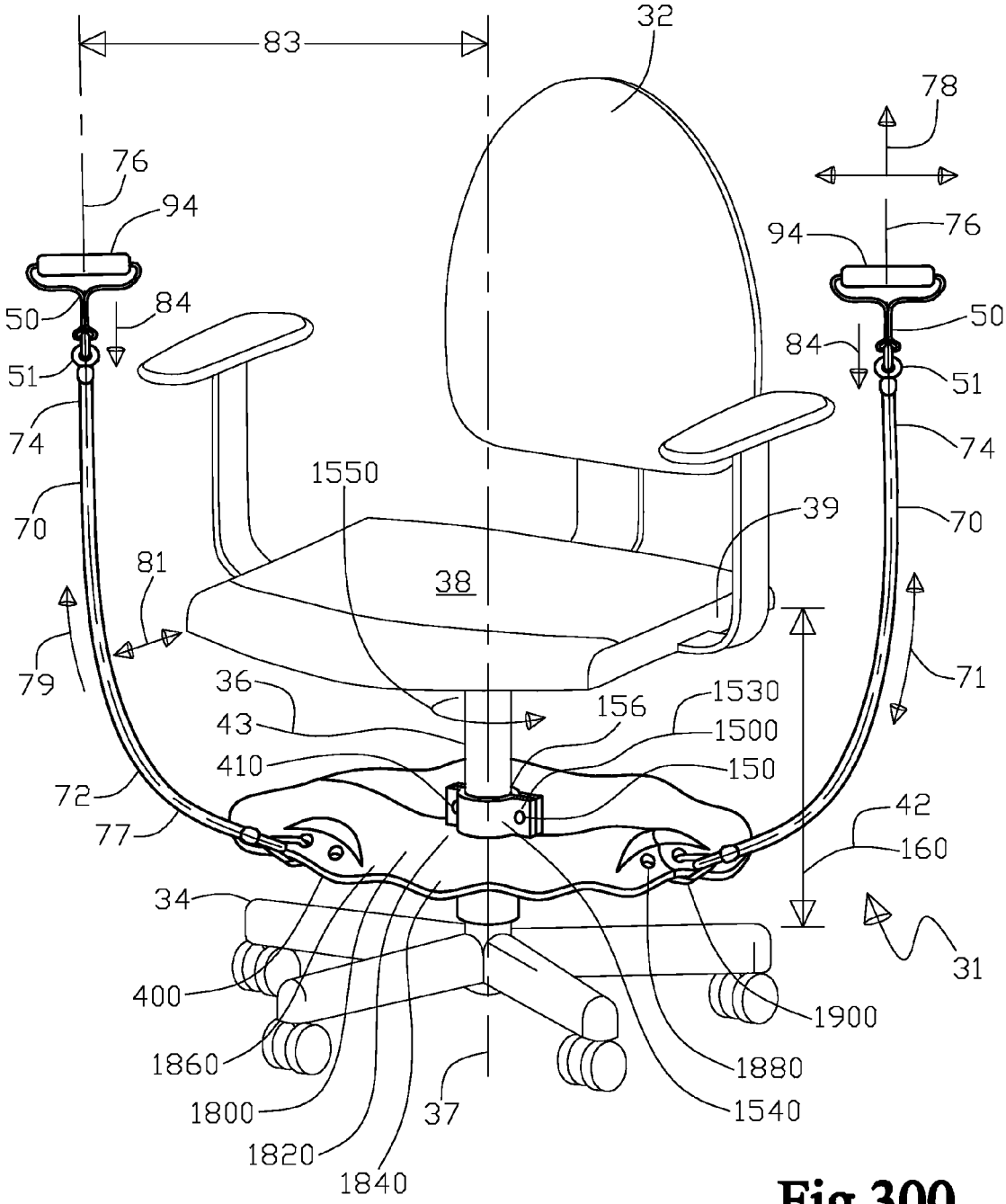
FIG. 300 is a perspective view of the alternative embodiment of the exercise apparatus.
Figure 301:
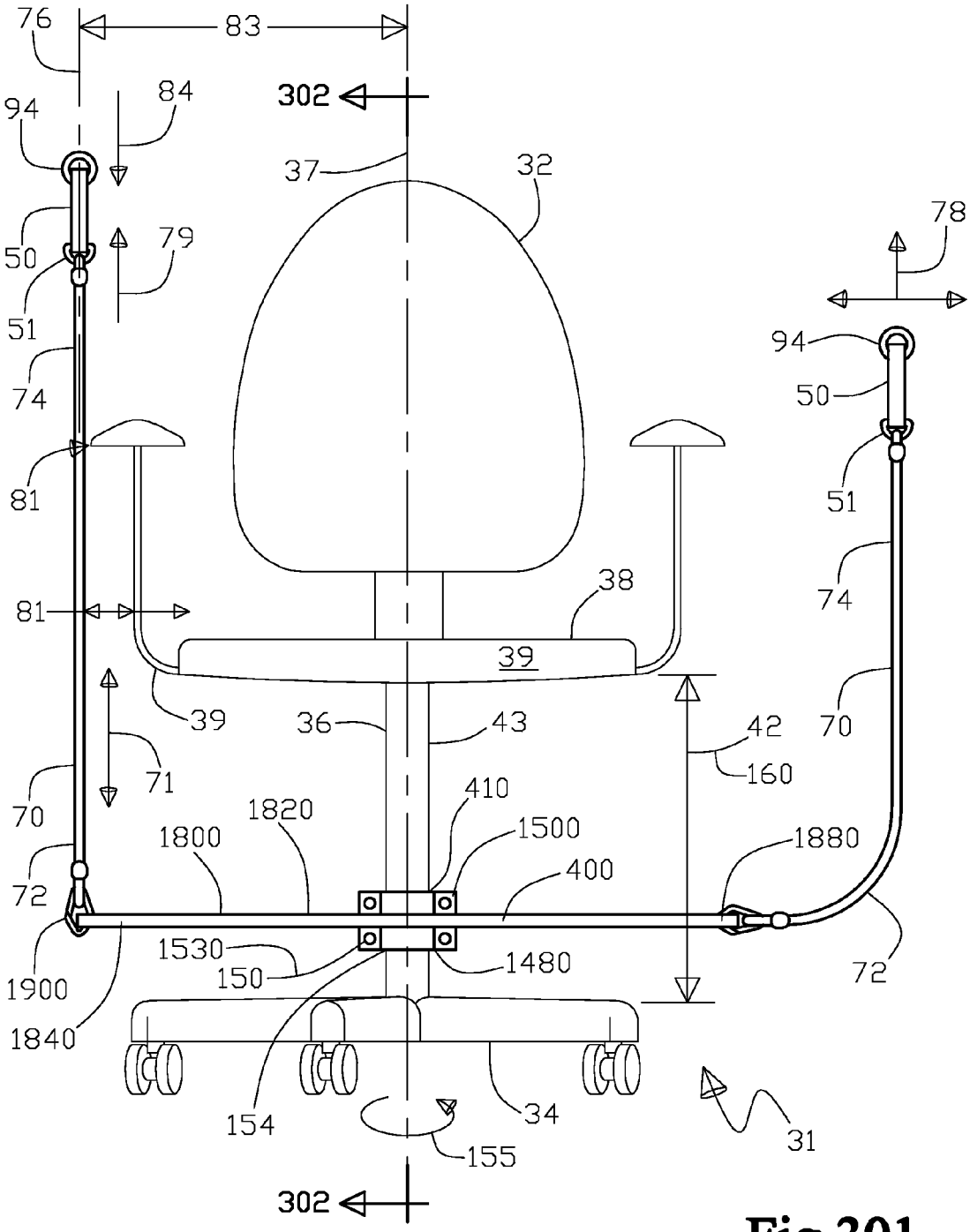
FIG. 301 is an elevation view of the alternative embodiment of the exercise apparatus also showing a longitudinal axis being substantially parallel to a lengthwise axis, wherein an elongate resilient member having a clearance to a seat outer margin being in a use state without the user shown for clarity.
Figure 302:
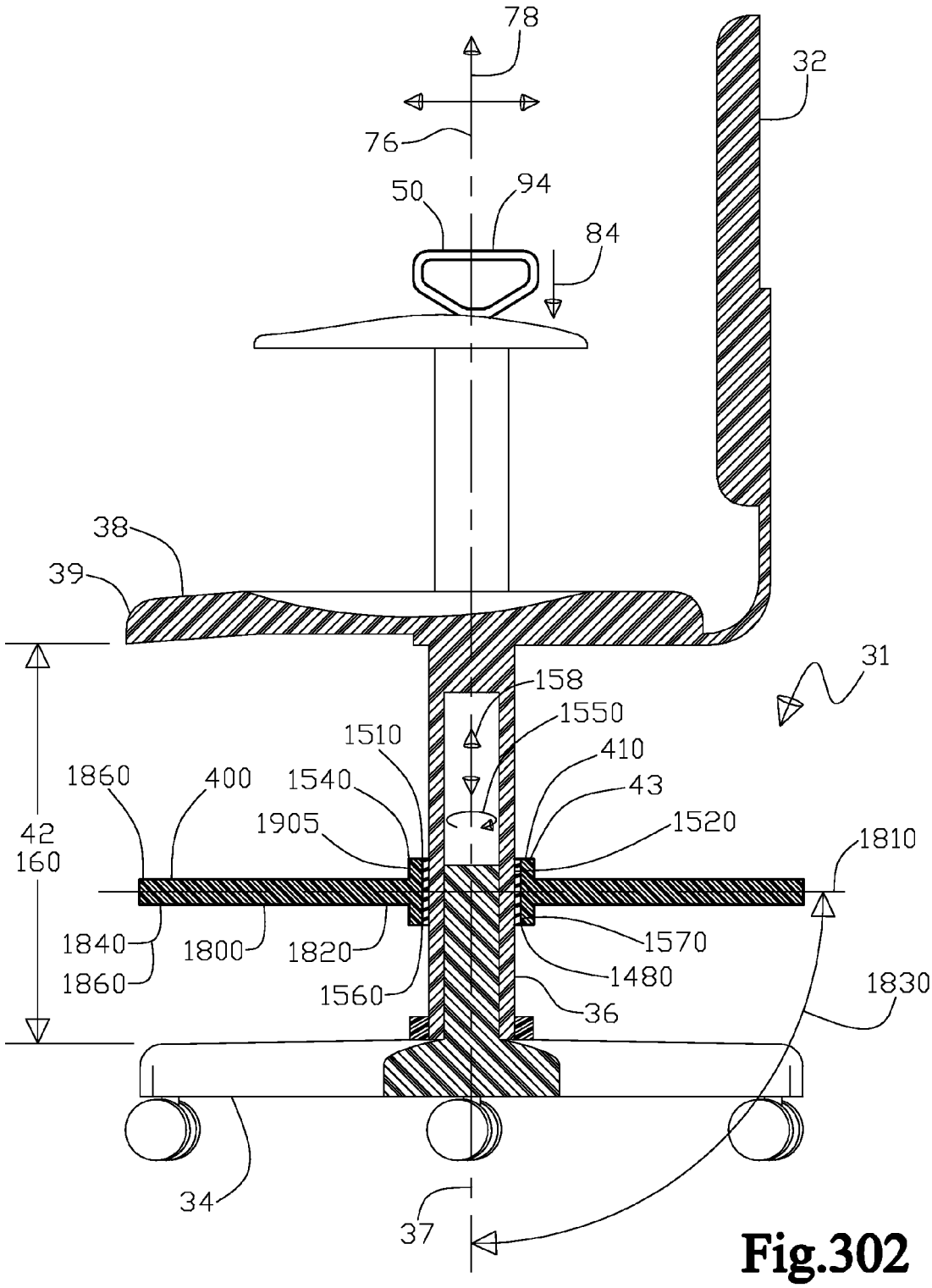
FIG. 302 is cross section 302 from FIG. 301 showing the support assembly interface with the chair pedestal for the alternative embodiment of the exercise apparatus.
Figure 303:
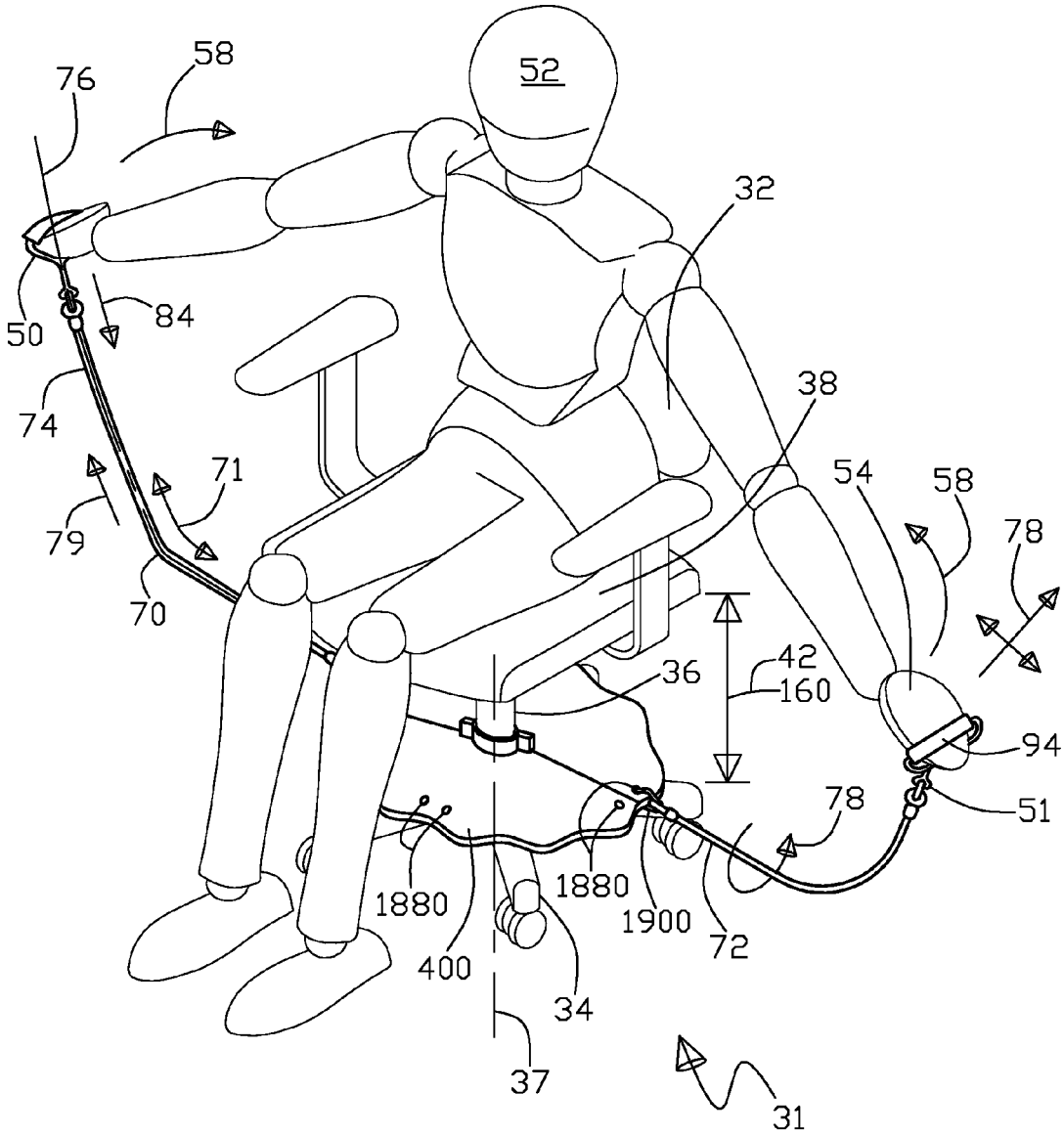
FIG. 303 is a perspective view of the alternative embodiment of the exercise apparatus in use, with the user performing the exercise of a deltoid lateral arm raise.
Figure 304:
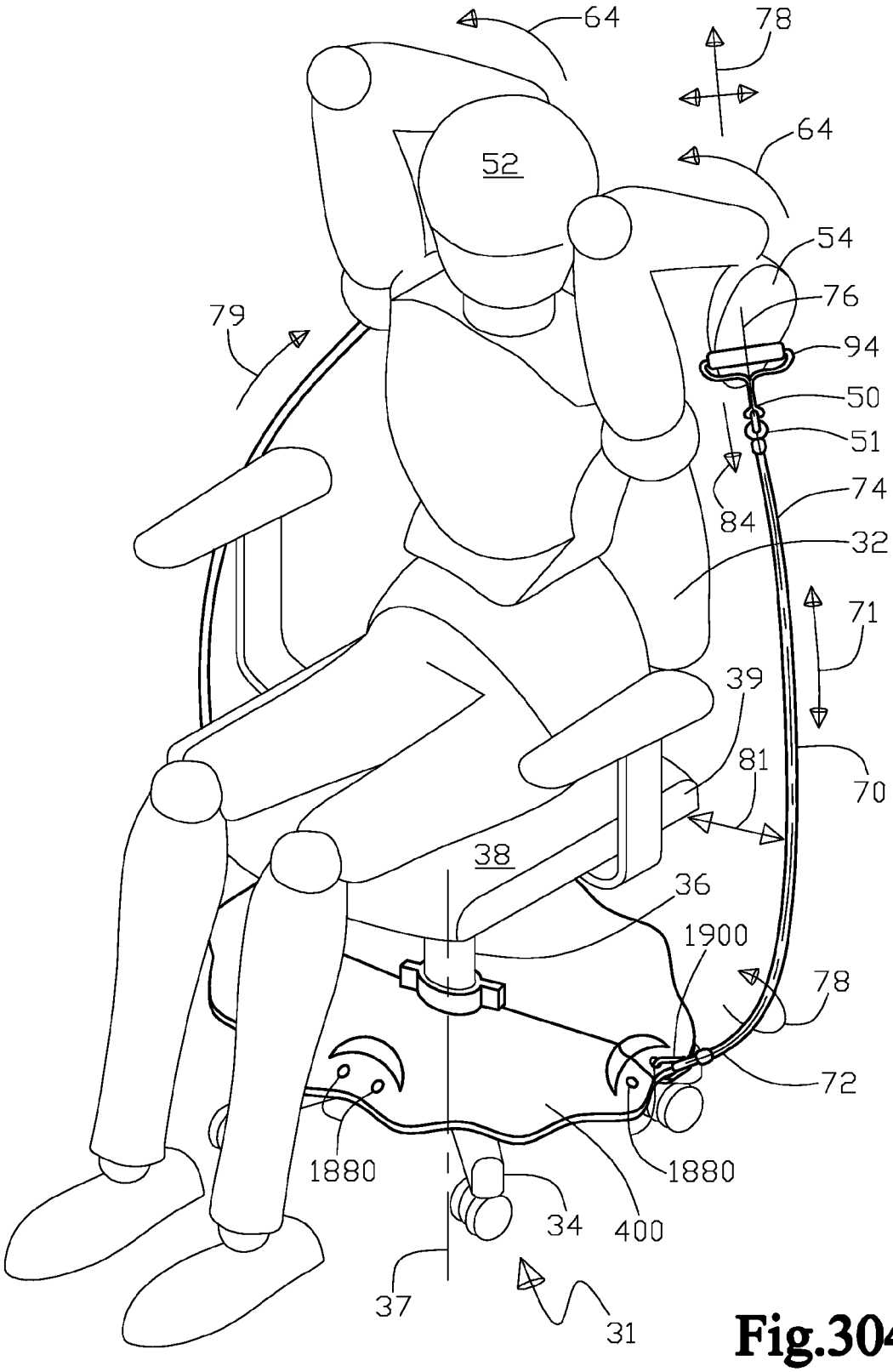
FIG. 304 is a perspective view of the alternative embodiment of the exercise apparatus again in use, with the user performing the exercise of a triceps arm extension.
Figure 305:
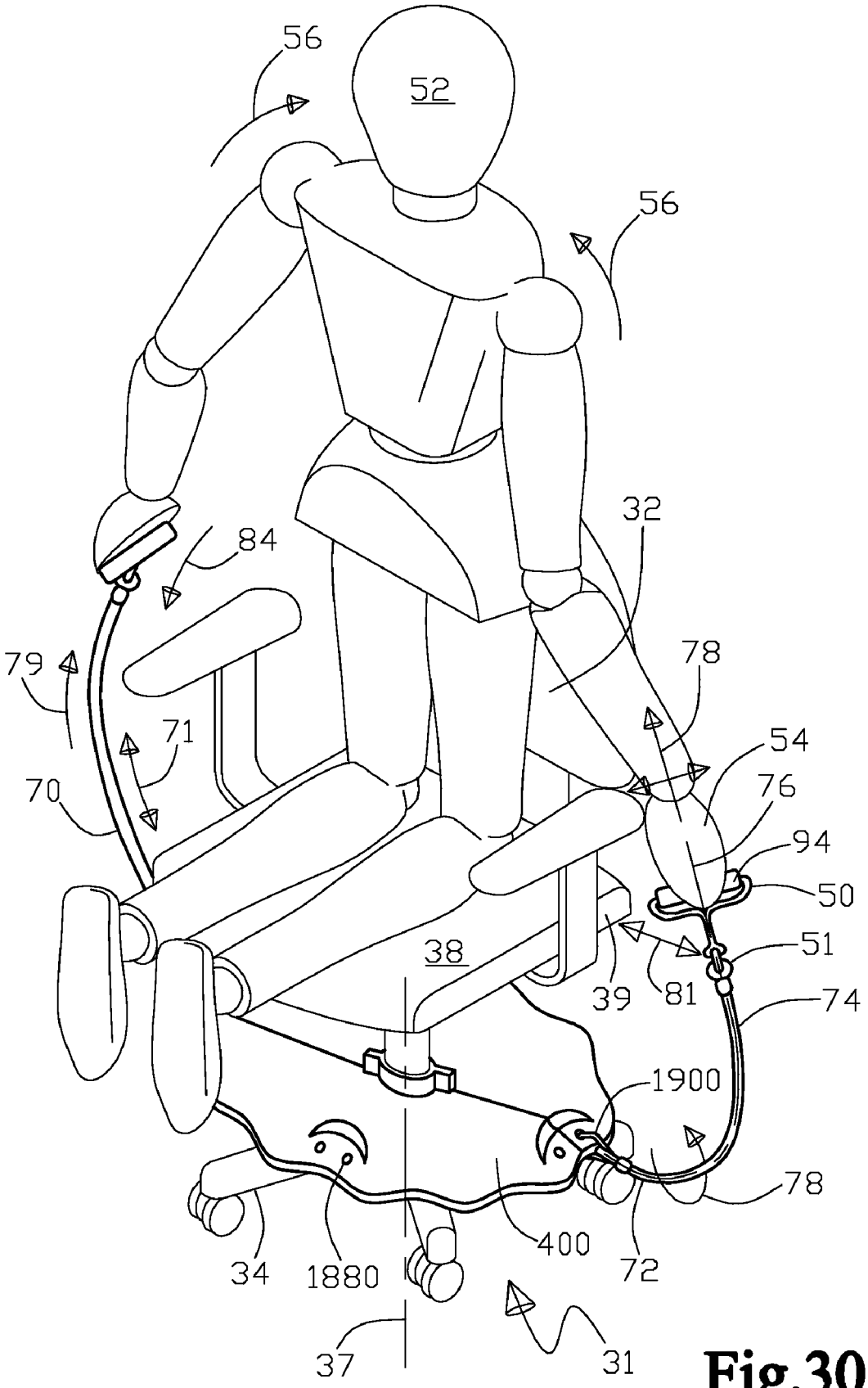
FIG. 305 is a perspective view of the alternative embodiment of the exercise apparatus also in use, with the user performing the exercise of a bicep curl.
Figure 306:
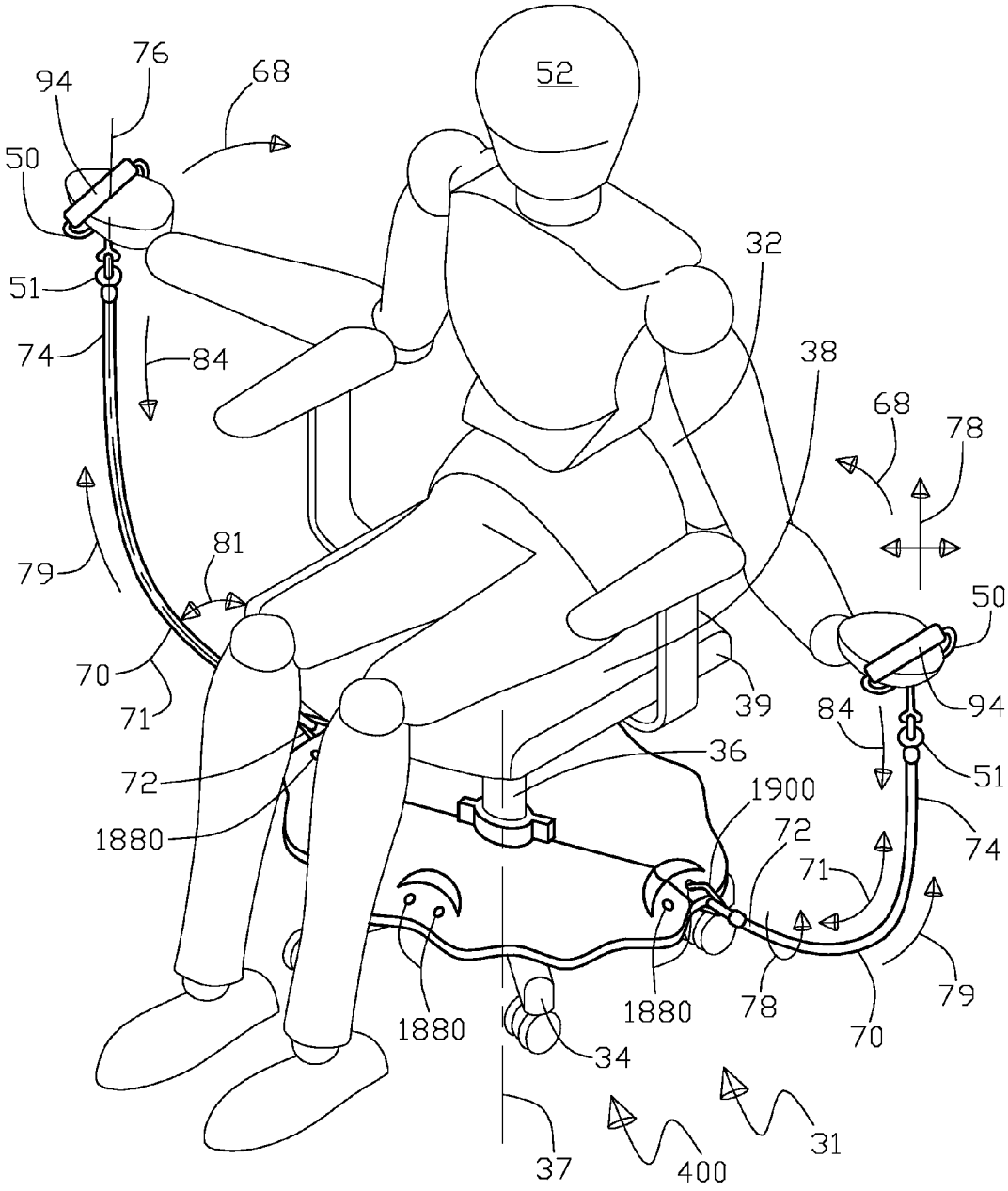
FIG. 306 is a perspective view of the alternative embodiment of the exercise apparatus also in use, with the user performing the exercise of a military arm press.

Looking toward the alternative embodiment of the exercise apparatus 31, with initial reference to FIG. 300 shown is a perspective view of the alternative embodiment of the exercise apparatus 31. Continuing, FIG. 301 is an elevation view of the alternative embodiment of the exercise apparatus 31 also showing the longitudinal axis 76 being substantially parallel 83 to the lengthwise axis 37, wherein the elongate resilient member 70 having clearance 81 to the seat 38 outer margin 39, in a use state without the user 52 for clarity. Further, FIG. 302 is cross section 302 from FIG. 301 showing the support assembly 400 interface with the chair pedestal 36 for the alternative embodiment 31. Next, FIG. 303 is a perspective view of the alternative embodiment of the exercise apparatus 31 in use, with the user 52 performing the exercise of a deltoid lateral arm raise 58 and FIG. 304 is a perspective view of the alternative embodiment of the exercise apparatus 31 again in use, with the user 52 performing the exercise of a triceps arm extension 64. Continuing, FIG. 305 is a perspective view of the alternative embodiment of the exercise apparatus 31 also in use, with the user 52 performing the exercise of a bicep curl 56 and FIG. 306 is a perspective view of the alternative embodiment of the exercise apparatus 31 also in use, with the user 52 performing the exercise of a military arm press 68.

Broadly, in referring to FIGS. 300 to 306, the present invention of the alternative embodiment of the exercise apparatus 31 is for use with a chair 32, the chair 32 including a base 34, a pedestal 36 having the lengthwise axis 37, and a seat 38 having an outer margin portion 39. The exercise apparatus 31 including a support assembly 400 that is adapted to removably attach to the chair 32 pedestal 36. In addition, the support assembly 400 is also to be substantially adjustably interposed between the chair 32 base 34 and the chair 32 seat 38, with the support assembly 400 sized and configured to be solely secured to the pedestal 36 perpendicular 1830 to the lengthwise axis 37 via a radial clamping force 1910, with the preferred purpose being to adjustably restrict movement of the support assembly 400 as between the base 34 and the seat 38, thus helping to restrict the support assembly 400 moving in relation to the pedestal 36 in a limited manner. Also included in the exercise apparatus 31 is an elongate resilient member 70 with a longitudinal axis 76, the member 70 having a proximal end portion 72 and a distal end portion 74, the proximal end portion 72 is adjacent to the support assembly 400, wherein operationally the elongate resilient member 70 has free omnidirectional movement 78 by not contacting the seat 38 outer margin portion 39 when the longitudinal axis 76 is substantially parallel 83 to the lengthwise axis 37, as is best shown in FIG. 301.

Further included in the exercise apparatus 31 is an attachment element 50 that is adjacent to the elongate resilient member 70 distal end portion 74, wherein the attachment element 50 is adapted to removably engage 51 to a portion of the user's 52 human anatomy 54 for the purpose of exercise by extending 79 along the longitudinal axis 76 of the elongate resilient member 70 by moving the attachment element 50 away from the support assembly 400 causing a resistive force 84 at the attachment element 50 with the resistive force 84 wholly determined by a spring rate 71 of the member 70, due to the member 70 being freely suspended during the extension 79 as between the proximal end portion 72 that is adjacent to the support assembly 400 and the distal end portion 74, due to the support assembly 400 sizing and configuring of the extension 1800 facilitating the member 70 to clear 81 the seat 38 outer margin 39, resulting in a "clean" exercise movement 79 by avoiding the member 70 contacting the margin 39 which could result in cutting of chaffing of the member 70 as against the margin 39 that could cause a fracture of the member 70 thereby increasing a safety risk to the user 52. Also if the member 70 contacts the margin 39 during exercise movement 79 it uncontrollably changes the spring rate or elasticity of the member 70 which in turn makes the resistive force 84 unpredictable making the exercise more difficult.

Alternatively, the exercise apparatus 31 support assembly 400 can include an extension 1810 with a first end portion 1820 and an opposing second end portion 1840, that extend along an axis 1810 that is substantially perpendicular 1830 to the lengthwise axis 37 wherein the first end portion 1820 is adjacent to the support assembly 400. The support assembly 400 further includes an outer periphery portion 1860 that extends approximately outwardly adjacent to the seat 38 outer margin portion 39 and is also substantially perpendicular 1830 to the chair 32 pedestal 36 lengthwise axis 37. Also, the support assembly 400 alternatively includes an aperture 1880 disposed on the outer periphery 1860, wherein the aperture 1880 is sized and configured to receive the member 70 proximal end portion 72 preferably by means of a removably engagable latching hook 1900. Additionally the exercise apparatus 31 can optionally have a plurality of apertures 1880 disposed within the outer periphery 1860 of the extension 1800 of the support assembly 400 and a plurality of elongate resilient members 70 each disposed within one of the plurality of apertures 1880 via a plurality of latching hooks 1900, wherein each of the elongate resilient members 70 each having different spring rates 71 resulting in different resistive forces 84, that are operational to further increase the number of exercises accommodated on the exercise apparatus 31.

The materials of construction for the elongate resilient member 70, of exercise apparatus 31, are preferably made from a thermoplastic elastomer material, which preferably has a good degree of elasticity, an ability to be formed into thin sheet-like bands, tubes, or cords and can undergo a number of expansion 79 cycles along its longitudinal axis 76, while repeatedly reassuming its original unexpanded configuration upon return of the member 70 to an non-expanded 79 free state 77. In constructing the resilient member 70 from the preferred materials as above, such thermoplastic elastomer materials are desirably non-allergenic; thus, an elongate resilient member used for exercise can be produced without the risks associated with the use of latex articles. In addition, processing parameters, material composition, and the like, for the construction of elongate resilient member 70, can be varied to achieve a desired value for the spring rate/K-factors, with the K typically in pounds per inch 71.

As described above for the elongate resilient member 70, the preferred type of thermoplastic elastomer is selected from the group consisting of styrene-butadiene-styrene block copolymers, styrene-ethylene/butylene-styrene block copolymers, or various mixtures thereof. Thermoplastic elastomers that are useful in forming the elongate resilient member 70 of the exercise apparatus 31 are commonly available under the trade name KRATON® Such KRATON® polymers have a block copolymer structure consisting of three discrete polymer blocks of the A-B-A type. The end blocks (A) are a hard thermoplastic (polystyrene) while the center blocks (B) are elastomers. The polystyrene end blocks are hard and strong at room temperature, and lock the elastomer blocks in place to give a physically cross-linked network, which provides the polymers with their elastomeric properties. Upon heating of the material, the polystyrene softens such that the polymer can be shaped or molded, with the polymer material hardening upon cooling. As a result, the physical cross-linking of the KRATON® polymers is a reversible process, unlike vulcanization processes which are generally used to make latex and rubber articles. The elongate resilient member 70 can alternatively also be made from, but is not limited to, a polyolefin elastomer such as the type sold under the trade name ENGAGE® by DuPont Dow Elastomers, L.L.C. The thermoplastic elastomer materials used to construct the resilient member 70 as stated above, also desirably include such conventional additives such as plasticizers, etc. to enhance in the extrudability of the material in amounts dependent on the thermoplastic elastomer material being used and the shape of articles being made. In addition, small amounts of additives can be included in the thermoplastic material to enhance its durability and shelf-life, of the elongate resilient member 70, such as anti-oxidizers and UV inhibitors.

Further, on the attachment element 50 it is preferably a handgrip 94. The handgrip 94 is a conventional type as best shown in FIGS. 300 to 302, wherein the handgrip 94 is adapted to removably engage a portion of the user's 52 anatomy 54, as best shown in FIGS. 303 to 306.

Returning to the support assembly 400, in particularly referencing FIGS. 300 to 302, the support assembly 400 includes a removable attachment 410 is preferably in the form of a split clamshell 1480 as best shown in FIGS. 300 to 302, the split clamshell 1480 includes a pair of outer removably attachable semicircular lengthwise split clamshell halves 1905 that are adjacent at a split line 1490, preferably including a plurality of quick release fasteners 1530 that are also adjacent to the split line 1490 as a means 1500 for removably engaging the split clamshell 1480. The quick release fasteners 1530 that are preferably the means 1500 can be buckle type, clamp type, nuts and bolts, or any other alternative fasteners that can removably clamp the pedestal 36 via the clamshells 1480 with enough of a frictional clamp to overcome the force 84 through the member 70. With the clamshell 1480 also including a split resilient liner 1520 that is preferably made of a stiff yet resilient material, such as rubber, that is operational to substantially accommodate differing pedestal sizes and functionally keeping the support assembly 400 substantially centered about the pedestal 36 to minimize the lateral "looseness" of the support assembly 400 or the clamshell 1480 in relation to the pedestal 36. In conjunction with the aforementioned lateral looseness minimization issue for the clam shell 1480 to the pedestal 36, another issue is the vertical looseness along axis 37 of the support assembly 400 between the base 34 and the seat 38, with the support assembly 400 being about the pedestal 36 due to the varying distance 160 between the base 34 and the seat 38 wherein the desirable adjustable interposing 43 of the support assembly 400 between the base 34 and the seat 38 to also minimize the vertical looseness along axis 37 of the support assembly 400 to the chair 32 to better enable a higher number of multiple exercises to be performed with the exercise apparatus 31. The support assembly 400 adjustable interposing 43 is preferably accomplished by use of an externally engaging substantially hollow lengthwise split shaped cylinder 1540 that will include a cylindrical axis 1550 positioned substantially radial to the lengthwise axis 37, the cylinder 1540 is removably engaged 1560 to an inner 1570 matably engaging surface 1510 of the split clamshell 1480, being operational to selectively adjust the support assembly 400 along the lengthwise axis 37 allow a selectable variable 160 distance 42 between the chair 32 base 34 and the chair 32 seat 38 allowing for the pedestal 36 movement along the lengthwise axis 37 for seat height adjustment. The support assembly 400 is preferably sized and configured to be solely secured to the pedestal 36 substantially perpendicular to the lengthwise axis 37, without the need for any securing about the end of the pedestal 36.

Method of Use

A method is disclosed for the multitude of uses or types of exercises that can be performed on the exercise apparatus 30, however, the following is not to be construed as limiting in any way the number of exercises that can be performed on the exercise apparatus 30. Referring in particular to FIGS. 21 to 28 a sampling of potential exercises is shown, starting with FIG. 21 showing a front perspective view of the exercise apparatus 30 shown in use for the butterfly 58 type exercise by an exercising human 52, with FIG. 22 showing a rear perspective view of the exercise apparatus 30 in use for the butterfly 58 type exercise by the exercising human 52, and FIG. 23 showing a front perspective view of the exercise apparatus 30 in use for the triceps 64 type exercise by the exercising human 52. Further, continuing to FIG. 24 shown is a rear perspective view of the exercise apparatus 30 in use for the triceps 64 type exercise by the exercising human 52, FIG. 25 shows a front perspective view of the exercise apparatus 30 in use for the shoulder shrug 68 type exercise by the exercising human 52, and FIG. 26 shows a rear perspective view of the exercise apparatus 30 in use for the shoulder shrug 68 type exercise by the exercising human 52. Next, FIG. 27 shows a front perspective view of the exercise apparatus 30 in use for the curling 56 type exercise by the exercising human 52, and FIG. 28 shows a rear perspective view of the exercise apparatus 30 in use for a curling 56 type exercise by the exercising human 52.

Note that a number of other exercises could be done on the exercise apparatus 30 that are not shown in FIGS. 21 to 28, such as referencing FIGS. 21 and 22 for a front butterfly by the human 52 leaning back in the chair 32 and referencing FIGS. 25 and 26 for a rear butterfly by the human 52 straddling the chair 32 backwards, or referencing FIGS. 27 and 28 for a military press by the human 52 that can be accomplished by selectively lengthening the attachment element 50, or referencing FIGS. 25 and 26 by the human 52 bending over to simulate a rowing type exercise or even a type of vat exercise by the human 52 pulling their arms to their sides. Also, in referencing FIGS. 27 and 28 the human 52 by pulling their arms in front of themselves could simulate a chest pull type of exercise, further by having the attachment element 50 removably attach to the human's 52 legs or feet, leg adduction and abduction exercises could be performed, as well as leg lifts and leg extensions, in addition referencing FIGS. 25 and 26 reverse leg extensions could be done to tone the gluteal, thigh biceps, and calf muscles. In addition, the attachment element 50 could attach to any other portion of the human 52 anatomy 54 outside of the human's hands, arms, legs or feet, for a multitude of possible other exercises to be performed with the exercise apparatus 30 by the human 52.

Looking to the alternative embodiment 31, a method of use is disclosed in FIGS. 303-306 for using the alternative embodiment exercise apparatus 31, adapted for use with a chair 32, the chair having a base 34, a pedestal 36 having a lengthwise axis 37, and a seat 38 having an outer margin portion 39, with a user adjacent to the chair 32. The first step is of providing the exercise apparatus 31 that includes the support assembly 400 in the form of a split clam shell 1480, with a pair of outer removably attachable semicircular lengthwise split clam shell 1480 halves 1905 that are adjacent at a split line 1490 that is adapted to removably attach 410 to the pedestal 36. The split clamshell halves 1905 also including a split resilient liner 1520 being operational to substantially accommodate differing pedestal sizes. The support assembly 400 is substantially adjustably interposed 43, sized and configured to be solely secured to the pedestal 36 perpendicular 1830 to the lengthwise axis 37 solely via a radial clamping force 1910. Further provided is the means 1500 for removably engaging 410 the split clamshell 1480 halves 1905 from the pedestal 36. Also providing an elongate resilient member 70 having a proximal end portion 72 and a distal end portion 74 in which the proximal end portion 72 is able to removably engage the support assembly 400 via a removably engagable latching hook 1900 disposed within an aperture 1880 on the outer periphery portion 1860 of the support assembly 400. The distal end portion 74 of the elongate resilient member 70, further includes a removable attachment 50 that is adapted to removably engage 51 to a portion of human 52 anatomy 54. The support assembly 400 engages removably by substantially encasing the pedestal 36 of the chair 32 without obstructing the movement of the pedestal 36 along the lengthwise axis 37 during a selectable adjustment 160 of distance 42 between the base 34 and the seat 42 by the user 52. Also providing, preferably, latching hooks 1900 that are adjacent to the elongate resilient member 70 proximal end portion 72.

A further step is of removably engaging the elongate resilient member 70 proximal end portion 72 to the aperture 1880 by use of the latching hook 1900. Further, in FIGS. 303 to 306 a next step is in removably engaging a portion of human 52 anatomy 54 by the user 52 to the removable attachment 50. Subsequently, a step of pulling in referencing FIGS. 303 to 306, the user 52, by pulling on the removable attachment 50, to have an extension 79 movement of the elongate resilient member 70 away from the support assembly 400 such that the longitudinal axis 76 and the lengthwise axis 37 are substantially parallel 83 to one another, see FIG. 301, consequently the elongate resilient member 70 does not contact the chair 32 seat 38 outer margin portion 39 resulting in a resistive force 84 from a constant spring rate 71 of the elongate resilient member 70 without obstruction or contact with the outer margin 39, resulting in operationally consistent resistive force 84 for the user's 52 exercise and a higher degree of safety as previously described.

Multiple types of exercises can be performed on the alternative embodiment exercise apparatus 31, however, the following is not to be construed as limiting in any way the number of exercises that can be performed on the exercise apparatus 31. FIG. 303 shows the user 52 performing the exercise of a deltoid lateral arm raise 58. FIG. 304 displays the user 52 performing the exercise of a triceps arm extension 64. Continuing, in reference to FIG. 305 the user 52 can perform the exercise of a bicep curl 56. Also in referencing FIG. 306 the user 52 is performing the exercise of a military arm press 68

CONCLUSION

Accordingly, the present invention of an exercise apparatus 30 or 31 has been described with some degree of particularity directed to the embodiments of the present invention. It should be appreciated, though, that the present invention is defined by the following claims construed in light of the prior art so modifications of the changes may be made to the exemplary embodiments of the present invention without departing from the inventive concepts contained therein.

The invention claimed is:

1. An exercise apparatus for use with a chair, the chair having a base, a pedestal having a lengthwise axis, and a seat having an outer margin portion, said exercise apparatus comprising:

(a) a support assembly in the form of a split clam shell that includes a pair of outer removably attachable semicircular lengthwise split clam shell halves that are adjacent to one another at a split line that is adapted to removably attach to the pedestal, said split clamshell halves also including a split resilient liner being operational to substantially accommodate differing pedestal sizes, said support assembly also to be substantially adjustably interposed, sized and configured to be solely secured to the pedestal perpendicular to said lengthwise axis via a radial clamping force, said support assembly also includes an extension with a first end portion that is adjacent to said support assembly and a second end portion that is formed into a continuous outer periphery portion that extends outward, being substantially perpendicular to the chair pedestal lengthwise axis and extending to being approximately adjacent to the seat outer margin portion, said continuous outer periphery portion includes a plurality of asymmetric apertures disposed within said continuous outer periphery portion;

(b) a means for removably engaging from the pedestal said split clamshell halves, (c) a plurality of elongate resilient members that each have a different spring rate for a different resistive force, each elongate resilient member includes a longitudinal axis, further each said elongate resilient member having a proximal end portion and a distal end portion, each said proximal end portion is adjacent to, a single aperture that is disposed within said outer periphery portion, wherein operationally each said elongate resilient member has free omnidirectional movement by not contacting the seat outer margin portion when said longitudinal axis is substantially parallel to said lengthwise axis; and (d) a plurality of attachment elements each adjacent to each said distal end portion, wherein each said attachment element is adapted to removably engage to a portion of human anatomy for the purpose of exercise by extending along said longitudinal axis of each said elongate resilient member by moving each said attachment element away from said outer periphery portion causing a different resistive force at each said attachment element with each said resistive force wholly determined by a spring rate of each said elongate resilient member, wherein said plurality of elongate resilient members and attachment elements are operational to further increase a number of exercises accommodated for a user.

2. An exercise apparatus according to claim 1 wherein said means includes a plurality of fasteners that are adjacent to said split line.

3. An exercise apparatus according to claim 1 wherein each said attachment element is sized and configured to be a handgrip.

4. A method for using an exercise apparatus adapted for use with a chair, the chair having a base, a pedestal having a lengthwise axis, and a seat having an outer margin portion, wherein a user is adjacent to the chair, which comprises the steps of:

(a) providing said exercise apparatus that includes a support assembly in the form of a split clam shell that includes a pair of outer removably attachable semicircular lengthwise split clam shell halves that are adjacent at a split line that is adapted to removably attach to the pedestal, said split clamshell halves also including a split resilient liner being operational to substantially accommodate differing pedestal sizes, said support assembly also to be substantially adjustably interposed, sized and configured to be solely secured to the pedestal perpendicular to said lengthwise axis solely via a radial clamping force, said support assembly also includes an extension with a first end portion that is adjacent to said support assembly and a second end portion that is formed into a continuous outer periphery portion that extends outward, being substantially perpendicular to the chair pedestal lengthwise axis and extending to being approximately adjacent to the seat outer margin portion, said continuous outer periphery portion includes a plurality of asymmetric apertures disposed within said continuous outer periphery portion, further included is a means for removably engaging said split clamshell halves from the pedestal, also included is a plurality of elongate resilient members that each have a different spring rate for a different resistive force, each elongate resilient member includes a longitudinal axis, further each said elongate resilient member having a proximal end portion and a distal end portion in which each said proximal end portion is able to removably engage a single aperture of said plurality of apertures via a single removably engagable latching hook disposed within said aperture on an said continuous outer periphery portion of said support assembly, for a plurality of latching hooks and apertures, each said distal end portion further includes a removable attachment that is adapted to removably engage to a portion of human anatomy;

(b) engaging removably said support assembly by substantially encasing the pedestal of the chair without obstructing movement of the pedestal along said lengthwise axis during a selectable adjustment of distance between the base and the seat by the user;

(c) engaging removably each said latching hook to each said aperture for each of said plurality of latching hooks and apertures;

(d) engaging removably by the user each said portion of human anatomy to each said removable attachment for a plurality of portions of human anatomy and removable attachments; and (e) pulling by the user on said plurality of removable attachments to have a plurality of extension movements of said elongate resilient members away from said support assembly such that said longitudinal axis and said lengthwise axis are substantially parallel to one another, wherein said plurality of elongate resilient members does not contact the chair seat outer margin portion resulting in a plurality of resistive forces from differing spring rates of said plurality of elongate resilient members without obstruction, resulting in to further increase a number of exercises accommodated for a user by simultaneously exercising a plurality of portions of human anatomy from different positions along said continuous periphery at different resistive forces.

* * * * *